US010594054B2

(12) United States Patent
Murugiah et al.

(10) Patent No.: US 10,594,054 B2
(45) Date of Patent: Mar. 17, 2020

(54) WEDGE CONNECTOR ASSEMBLIES AND METHODS AND CONNECTIONS INCLUDING SAME

(71) Applicants: TE Connectivity Corporation, Berwyn, PA (US); Tyco Electronics Canada ULC, Markham (CA)

(72) Inventors: Sachidanandan Murugiah, Stouffville (CA); Barry James Johnson, Vaughan (CA); Steve Mitchell, Thompsons Station, TN (US); Jonathan Guppy, Markham (CA)

(73) Assignees: Tyco Electronics Canada ULC, Markham (CA); TE Connectivity Services GmbH, Schaffhausen (CH)

( * ) Notice: Subject to any disclaimer, the term of this patent is extended or adjusted under 35 U.S.C. 154(b) by 0 days.

(21) Appl. No.: 15/961,422

(22) Filed: Apr. 24, 2018

(65) Prior Publication Data

US 2018/0331435 A1 Nov. 15, 2018

Related U.S. Application Data

(60) Provisional application No. 62/503,695, filed on May 9, 2017.

(51) Int. Cl.
*H01R 4/50* (2006.01)
*H01R 43/26* (2006.01)

(52) U.S. Cl.
CPC ..... *H01R 4/5091* (2013.01); *H01R 4/50* (2013.01); *H01R 4/5083* (2013.01); *H01R 43/26* (2013.01)

(58) Field of Classification Search
CPC ..... H01R 4/50; H01R 4/5091; H01R 4/5083
See application file for complete search history.

(56) References Cited

U.S. PATENT DOCUMENTS 3,290,746 A 12/1966 Broske
3,345,454 A 10/1967 Lenhart, Jr.
(Continued)

FOREIGN PATENT DOCUMENTS

CA 2334187 8/2002
CN 2634667 8/2004
(Continued)

OTHER PUBLICATIONS

Grupo Intelli General Catalog www.grupointelli.com IntMKT Set/2009 (52 pages) (Jan. 2009).
(Continued)

*Primary Examiner* — Briggitte R. Hammond
(74) *Attorney, Agent, or Firm* — Myers Bigel, P.A.

(57) ABSTRACT

A wedge connector system for connecting first and second elongate electrical conductors includes a C-shaped sleeve member, a wedge member and a locking mechanism. The sleeve member defines a sleeve cavity and opposed first and second sleeve channels on either side of the sleeve cavity. The wedge member includes a wedge body having first and second opposed wedge side walls. The locking mechanism includes a lock member including a sleeve engagement portion, and a clamping mechanism coupled to the wedge member. The sleeve member and the wedge member are configured to capture the first and second conductors such that the first conductor is received in the first sleeve channel between the sleeve member and the first wedge side wall and the second conductor is received in the second sleeve channel between the sleeve member and the second wedge side wall. The locking mechanism is mountable on the sleeve member and the wedge member such that the sleeve engagement portion interlocks with the sleeve member and the clamping mechanism can be operated to force the wedge
(Continued)

member into the sleeve cavity to apply clamping loads on the first and second conductors.

19 Claims, 32 Drawing Sheets

(56) References Cited

U.S. PATENT DOCUMENTS

| | | | | |
|---|---|---|---|---|
| 3,469,721 | A | 9/1969 | Mitchell et al. | |
| 3,515,794 | A | 6/1970 | Ernest et al. | |
| 3,681,512 | A | 8/1972 | Werner et al. | |
| 3,742,582 | A | 7/1973 | Broske | |
| 3,761,602 | A | 9/1973 | De Sio et al. | |
| 3,826,860 | A | 7/1974 | De Sio et al. | |
| 4,027,939 | A | 6/1977 | White | |
| 4,114,977 | A | 9/1978 | Polidori | |
| 4,252,992 | A | 2/1981 | Cherry et al. | |
| 4,279,461 | A | 7/1981 | Bussen et al. | |
| 4,415,222 | A | 11/1983 | Polidori | |
| 4,600,264 | A | 7/1986 | Counsel | |
| 4,722,189 | A | 2/1988 | Center | |
| 4,752,252 | A | 6/1988 | Cherry et al. | |
| 4,857,020 | A * | 8/1989 | Crosby | H01R 4/5091 439/783 |
| 4,863,403 | A | 9/1989 | Shannon | |
| RE33,098 | E | 10/1989 | Center | |
| 5,090,923 | A | 2/1992 | Kenyon et al. | |
| 5,092,797 | A | 3/1992 | Cole et al. | |
| 5,244,422 | A | 9/1993 | Laricchia | |
| 5,340,335 | A | 8/1994 | Haun | |
| 5,423,699 | A | 6/1995 | Johnson | |
| 5,538,447 | A | 7/1996 | Chadbourne et al. | |
| 5,600,096 | A | 2/1997 | Cherry et al. | |
| 5,683,273 | A | 11/1997 | Garver | |
| 5,692,930 | A | 12/1997 | Garver et al. | |
| 5,774,987 | A | 7/1998 | Chadbourne et al. | |
| 5,794,334 | A | 8/1998 | Chadbourne et al. | |
| 5,862,589 | A | 1/1999 | Chadbourne et al. | |
| 5,916,001 | A | 6/1999 | Chadbourne | |
| 6,093,064 | A | 7/2000 | Callen et al. | |
| 6,261,117 | B1 | 7/2001 | Lacroix | |
| 6,309,261 | B1 | 10/2001 | Chadbourne | |
| 6,817,909 | B2 | 11/2004 | Dobrinski et al. | |
| 6,851,262 | B1 | 2/2005 | Gregory et al. | |
| 6,895,663 | B2 | 5/2005 | Itrich | |
| 6,979,236 | B1 | 12/2005 | Stanton | |
| 6,996,987 | B2 | 2/2006 | Gregory et al. | |
| 7,182,653 | B1 | 2/2007 | Hoxha | |
| 7,309,263 | B2 | 12/2007 | Copper et al. | |
| 7,387,546 | B2 | 6/2008 | Copper et al. | |
| 7,426,782 | B2 | 9/2008 | Johnson et al. | |
| 7,494,385 | B2 | 2/2009 | Copper et al. | |
| 7,677,933 | B2 | 3/2010 | Copper et al. | |
| 7,686,661 | B2 | 3/2010 | Shrum et al. | |
| 7,766,702 | B2 * | 8/2010 | De France | H01H 33/6661 439/772 |
| 7,819,706 | B2 | 10/2010 | Copper et al. | |
| 7,845,990 | B2 | 12/2010 | Shrum et al. | |
| 7,862,390 | B2 | 1/2011 | Copper | |
| 7,997,943 | B2 | 8/2011 | Gregory et al. | |
| 8,176,625 | B2 | 5/2012 | Copper et al. | |
| 8,550,842 | B1 | 10/2013 | Gutierrez et al. | |
| 8,608,517 | B2 | 12/2013 | La Salvia et al. | |
| 9,059,522 | B2 | 6/2015 | Spalding et al. | |
| 2003/0148671 | A1 | 8/2003 | Mello et al. | |
| 2004/0029455 | A1 | 2/2004 | Johnson et al. | |
| 2004/0203294 | A1 | 10/2004 | Mello et al. | |
| 2006/0148333 | A1 | 7/2006 | Peterson | |
| 2006/0148334 | A1 | 7/2006 | Conn et al. | |
| 2008/0026644 | A1 | 1/2008 | De France et al. | |
| 2010/0003864 | A1 | 1/2010 | Fuzetti et al. | |
| 2010/0151735 | A1 | 6/2010 | Crutcher et al. | |
| 2010/0314232 | A1 | 12/2010 | Gregory et al. | |

FOREIGN PATENT DOCUMENTS

| | | |
|---|---|---|
| WO | 00/01035 | 1/2000 |
| WO | 2008/013891 | 1/2008 |

OTHER PUBLICATIONS

Tyco Electronics Energy Division Ready Reference Guide, retrieved from http://energy.tycoelectronics.com (143 pages) (Published at least as early as Sep. 2011).

"U.D.C.—Universal Distribution Connector Reinforced" Tyco Electronics, Catalog 125003 (8 pages) (Mar. 1999).

AMPACT Taps, Stirrups, and Application Tooling, Customer Manual 409-2106 Rev M (39 pages) (Feb. 5, 1999).

"Automatic connectors Reliable for wires, strands and conductors" Dribo, spol. s r.o. (4 pages) (Oct. 2003).

Notification of Transmittal of the International Search Report and the Written Opinion of the International Searching Authority, or the Declaration, in corresponding PCT Application No. PCT/US2018/030439 (16 pages) (dated Jul. 19, 2018).

Shear-Lok Grounding Connector data sheet, TE Connectivity (2 pages) (2014).

Wrench-Lok data sheet, TE Connectivity (2 pages) (2014).

* cited by examiner

WEDGE CONNECTOR ASSEMBLIES AND METHODS AND CONNECTIONS INCLUDING SAME

RELATED APPLICATION(S)

The present application claims the benefit of and priority from U.S. Provisional Patent Application No. 62/503,695, filed May 9, 2017, the disclosure of which is incorporated herein by reference in its entirety.

FIELD OF THE INVENTION

The present invention relates to electrical connectors and, more particularly, to power utility electrical connectors and methods and connections including the same.

BACKGROUND OF THE INVENTION

Electrical utility firms constructing, operating and maintaining overhead and/or underground power distribution networks and systems utilize connectors to tap main power transmission conductors and feed electrical power to distribution line conductors, sometimes referred to as tap conductors. The main power line conductors and the tap conductors are typically high voltage cables that are relatively large in diameter, and the main power line conductor may be differently sized from the tap conductor, requiring specially designed connector components to adequately connect tap conductors to main power line conductors. Generally speaking, four types of connectors are commonly used for such purposes, namely bolt-on connectors, compression-type connectors, wedge connectors, and transverse wedge connectors.

Bolt-on connectors typically employ die-cast metal connector pieces or connector halves formed as mirror images of one another, sometimes referred to as clam shell connectors. Each of the connector halves defines opposing channels that axially receive the main power conductor and the tap conductor, respectively, and the connector halves are bolted to one another to clamp the metal connector pieces to the conductors.

Compression connectors, instead of utilizing separate connector pieces, may include a single metal piece connector that is bent or deformed around the main power conductor and the tap conductor to clamp them to one another.

Wedge connectors are also known that include a C-shaped channel member that hooks over the main power conductor and the tap conductor, and a wedge member having channels in its opposing sides is driven through the C-shaped member, deflecting the ends of the C-shaped member and clamping the conductors between the channels in the wedge member and the ends of the C-shaped member. One such wedge connector is commercially available from TE Connectivity and is known as an AMPACT Tap or Stirrup Connector. AMPACT connectors include different sized channel members to accommodate a set range of conductor sizes, and multiple wedge sizes for each channel member. Each wedge accommodates a different conductor size.

Exemplary transverse wedge connectors are disclosed in U.S. Pat. Nos. 8,176,625, 7,997,943, 7,862,390, 7,845,990, 7,686,661, 7,677,933, 7,494,385, 7,387,546, 7,309,263, and 7,182,653.

SUMMARY OF THE INVENTION

According to embodiments of the present invention, a wedge connector system for connecting first and second elongate electrical conductors includes a C-shaped sleeve member, a wedge member and a locking mechanism. The sleeve member defines a sleeve cavity and opposed first and second sleeve channels on either side of the sleeve cavity. The wedge member includes a wedge body having first and second opposed wedge side walls. The locking mechanism includes a lock member including a sleeve engagement portion, and a clamping mechanism coupled to the wedge member. The sleeve member and the wedge member are configured to capture the first and second conductors such that the first conductor is received in the first sleeve channel between the sleeve member and the first wedge side wall and the second conductor is received in the second sleeve channel between the sleeve member and the second wedge side wall. The locking mechanism is mountable on the sleeve member and the wedge member such that the sleeve engagement portion interlocks with the sleeve member and the clamping mechanism can be operated to force the wedge member into the sleeve cavity to apply clamping loads on the first and second conductors.

According to embodiments of the present invention, a method for connecting first and second elongate electrical conductors includes providing a wedge connector assembly including: a C-shaped sleeve member defining a sleeve cavity and opposed first and second sleeve channels on either side of the sleeve cavity; a wedge member including a wedge body having first and second opposed wedge side walls; and a locking mechanism. The locking mechanism includes a lock member including a sleeve engagement portion, and a clamping mechanism coupled to the wedge member. The method further includes: using the sleeve member and the wedge member, capturing the first and second conductors such that the first conductor is received in the first sleeve channel between the sleeve member and the first wedge side wall and the second conductor is received in the second sleeve channel between the sleeve member and the second wedge side wall; and mounting the locking mechanism on the sleeve member and the wedge member such that the sleeve engagement portion interlocks with the sleeve member; and thereafter operating the clamping mechanism to force the wedge member into the sleeve cavity to apply clamping loads on the first and second conductors.

According to embodiments of the present invention, an electrical connection includes a wedge connector assembly and first and second elongate electrical conductors. The wedge connector assembly includes: a C-shaped sleeve member defining a sleeve cavity and opposed first and second sleeve channels on either side of the sleeve cavity; a wedge member including a wedge body having first and second opposed wedge side walls; and a locking mechanism. The locking mechanism includes a lock member including a sleeve engagement portion, and a clamping mechanism coupled to the wedge member. The first and second elongate electrical conductors are captured between the sleeve member and the wedge member such that the first conductor is received in the first sleeve channel between the sleeve member and the first wedge side wall and the second conductor is received in the second sleeve channel between the sleeve member and the second wedge side wall. The locking mechanism is mounted on the sleeve member and the wedge member such that the sleeve engagement portion interlocks with the sleeve member. The clamping mechanism secures the wedge member in the sleeve cavity to apply clamping loads on the first and second conductors.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
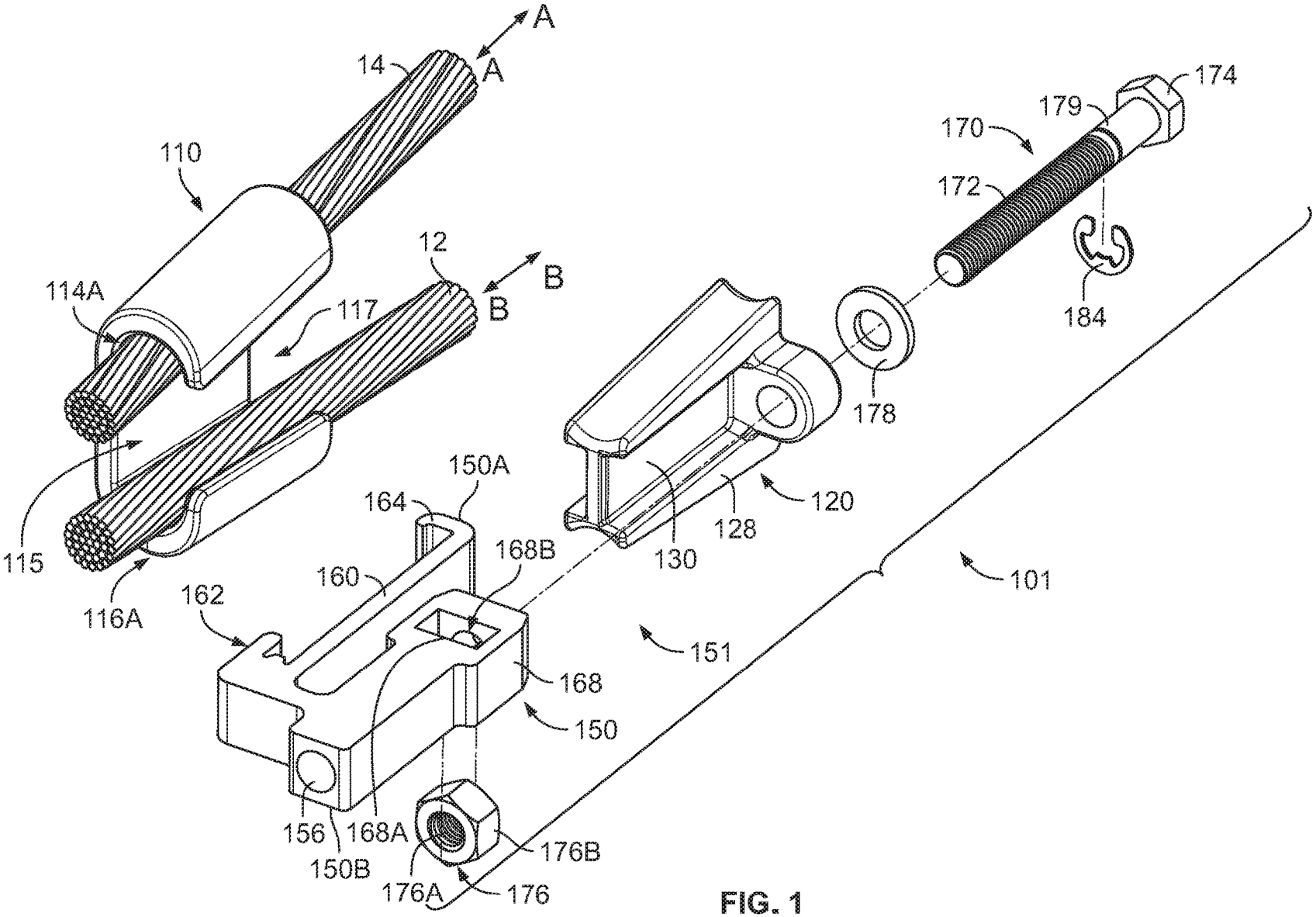
FIG. 1 is an exploded, front perspective view of a wedge connector system according to embodiments of the invention and a pair of conductors.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this disclosure and the relevant art and will not be interpreted in an idealized or overly formal sense unless expressly so defined herein.

As used herein, "monolithic" means an object that is a single, unitary piece formed or composed of a material without joints or seams.

With reference to FIGS. 1-8, a wedge connector system or kit 101 and a wedge connector assembly 100 according to embodiments of the present invention is shown therein. The wedge connector system 101 can be used to form a connection 5 (FIGS. 3-6) including a pair of elongate electrical conductors 12, 14 (e.g., electrical power lines) mechanically and electrically coupled by the wedge connector assembly 100. The connector assembly 100 may be adapted for use as a tap connector for connecting an elongate tap conductor 12 to an elongate main conductor 14 of a utility power distribution system, for example.

The tap conductor 12, sometimes referred to as a distribution conductor, may be a known electrically conductive metal high voltage cable or line having a generally cylindrical form in an exemplary embodiment. The main conductor 14 may also be a generally cylindrical high voltage cable line. The tap conductor 12 and the main conductor 14 may be of the same wire gage or different wire gage in different applications and the connector assembly 100 is adapted to accommodate a range of wire gages for each of the tap conductor 12 and the main conductor 14. The conductor 12 has a lengthwise axis B-B and the conductor 14 has a lengthwise axis A-A.

When installed to the tap conductor 12 and the main conductor 14, the connector assembly 100 provides electrical connectivity between the main conductor 14 and the tap conductor 12 to feed electrical power from the main conductor 14 to the tap conductor 12 in, for example, an electrical utility power distribution system. The power distribution system may include a number of main conductors 14 of the same or different wire gage, and a number of tap conductors 12 of the same or different wire gage.

The conductors 12, 14 each include a plurality of separable elongate strands 12A, 14A. Alternatively, one of the conductors 12, 14 may be solid.

Figure 5:
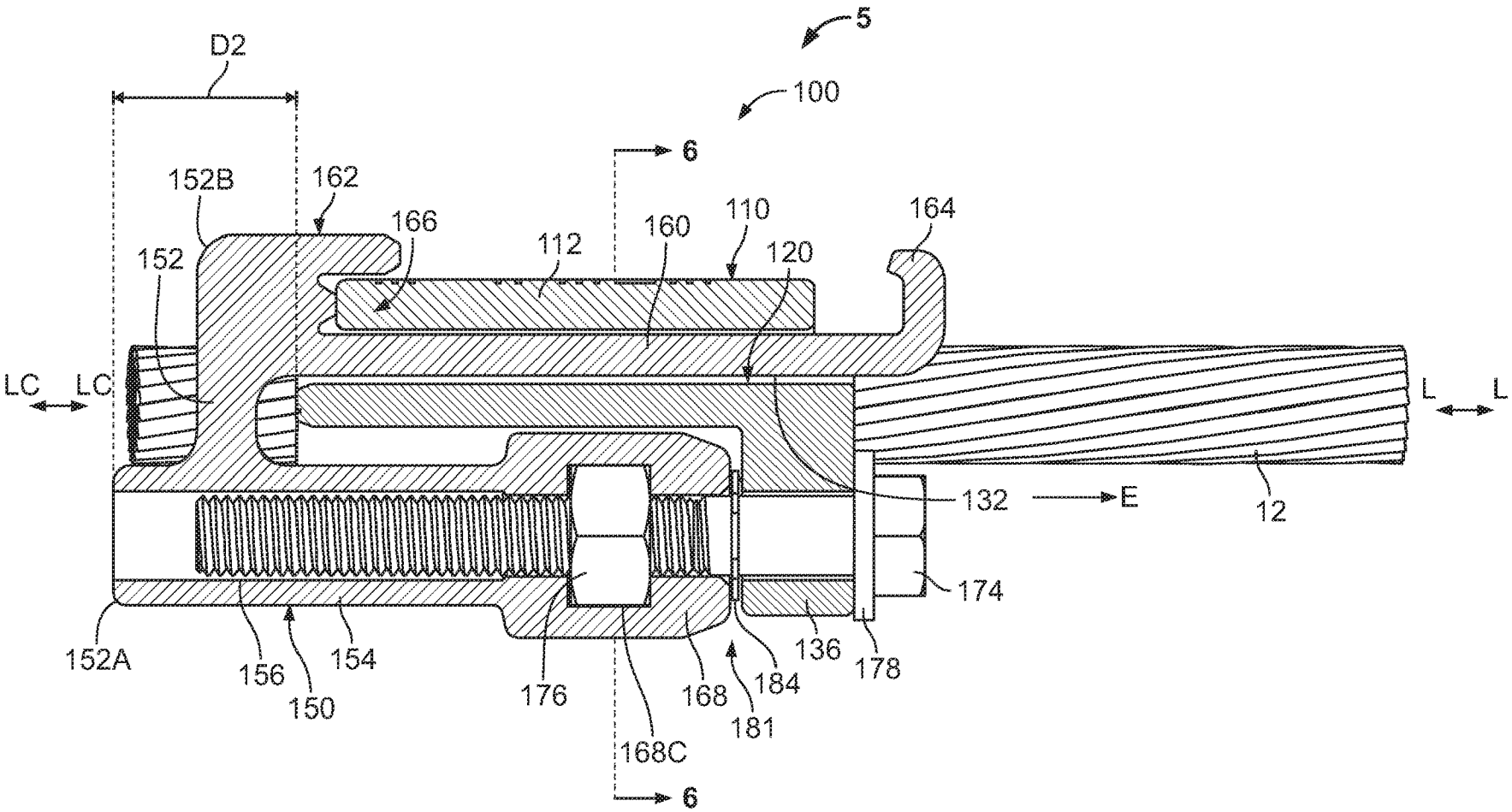
FIG. 5 is a cross-sectional view of the wedge connector assembly of FIG. 3 taken along the line 5-5 of FIG. 3.
Figure 6:
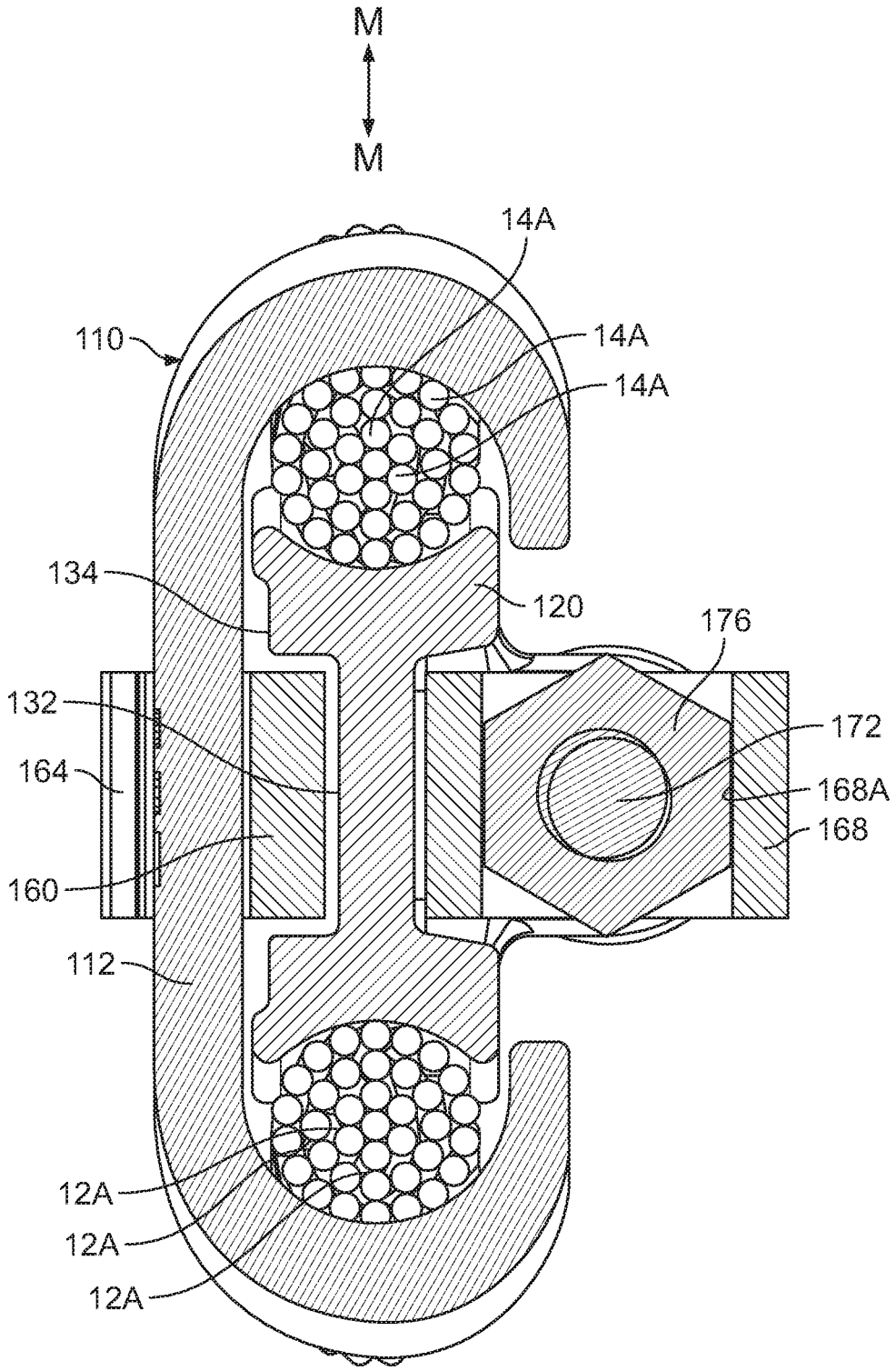
FIG. 6 is a cross-sectional view of the wedge connector assembly of FIG. 3 taken along the line 6-6 of FIG. 5.

With reference to FIG. 1, the wedge connector system 101, and the wedge connector assembly 100 formed therefrom, include a C-shaped channel or sleeve member 110, a wedge member 120, a drive/lock mechanism 151, and a retraction mechanism 181 (FIG. 5). The sleeve member 110 and the wedge member 120 are movable relative to one another to cooperatively mechanically capture the conductors 12, 14 therebetween and electrically connect the conductors 12, 14 to one another.

Figure 3:
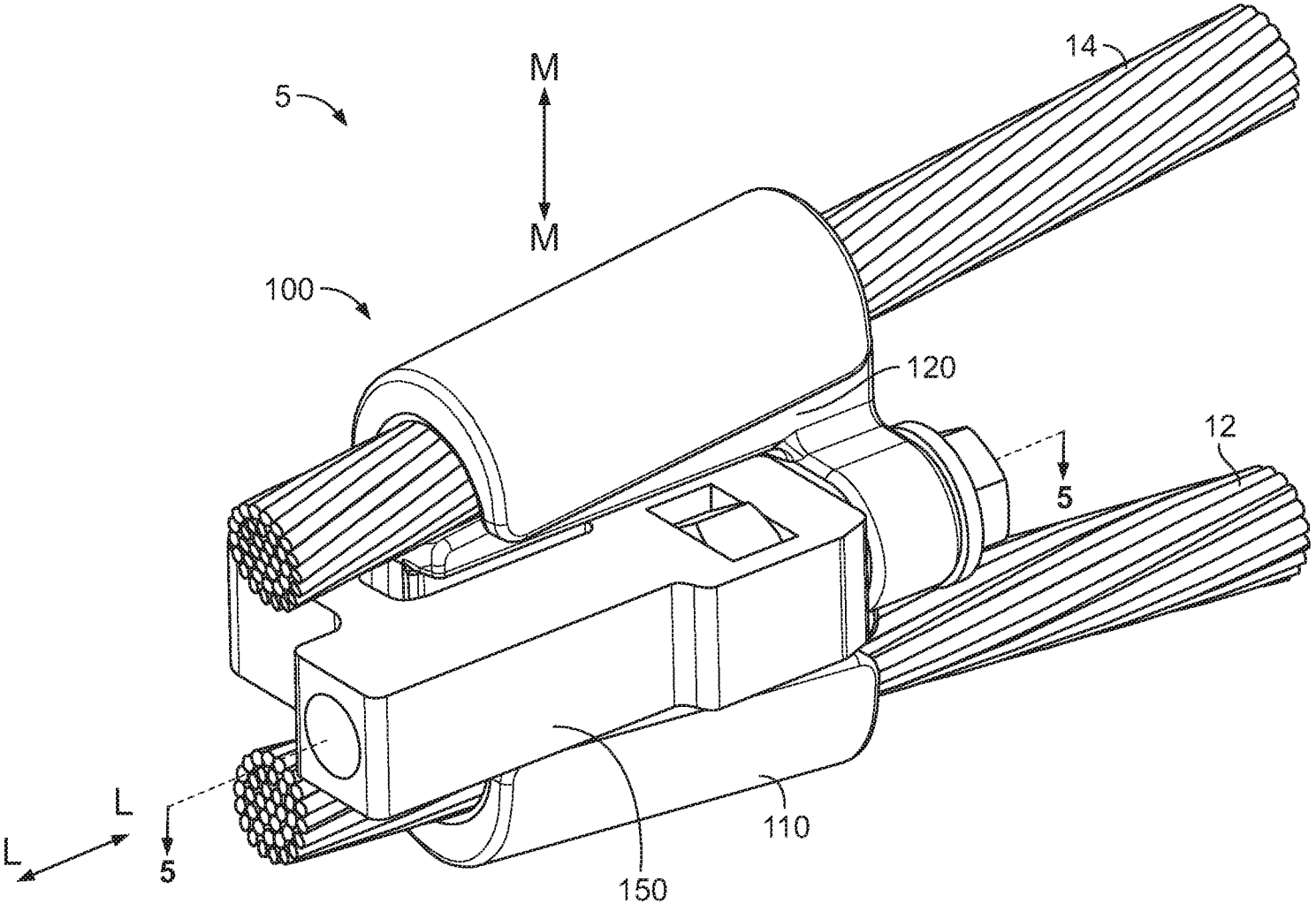
FIG. 3 is a front perspective view of a connection including a wedge connector assembly formed from the wedge connector system of FIG. 1.
Figure 4:
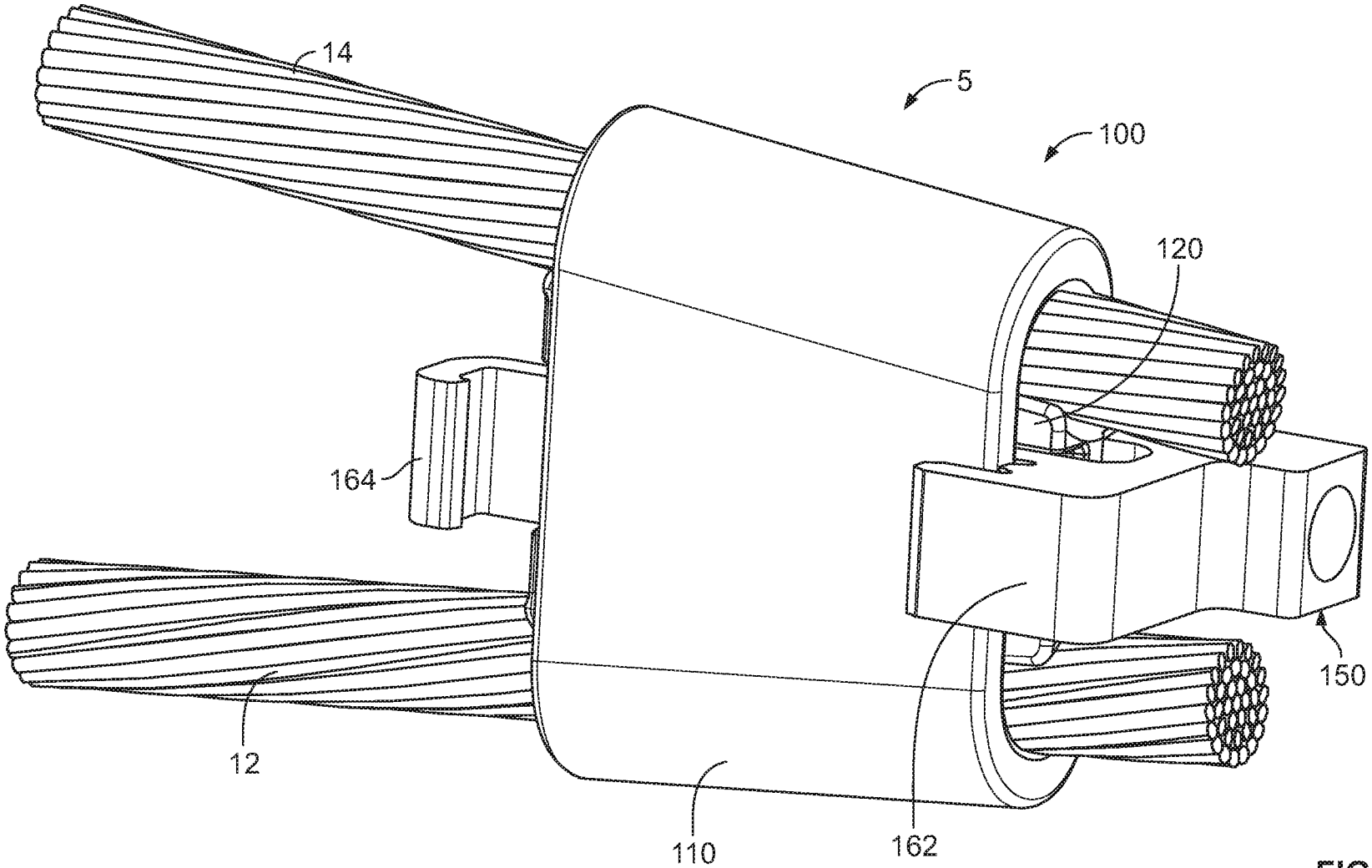
FIG. 4 is a front perspective view of the wedge connector assembly of FIG. 3 from an opposing side of the wedge connector assembly.

With reference to FIG. 3, the assembled connector assembly 100 has a lengthwise axis L-L and a transverse axis M-M.

Figure 7:
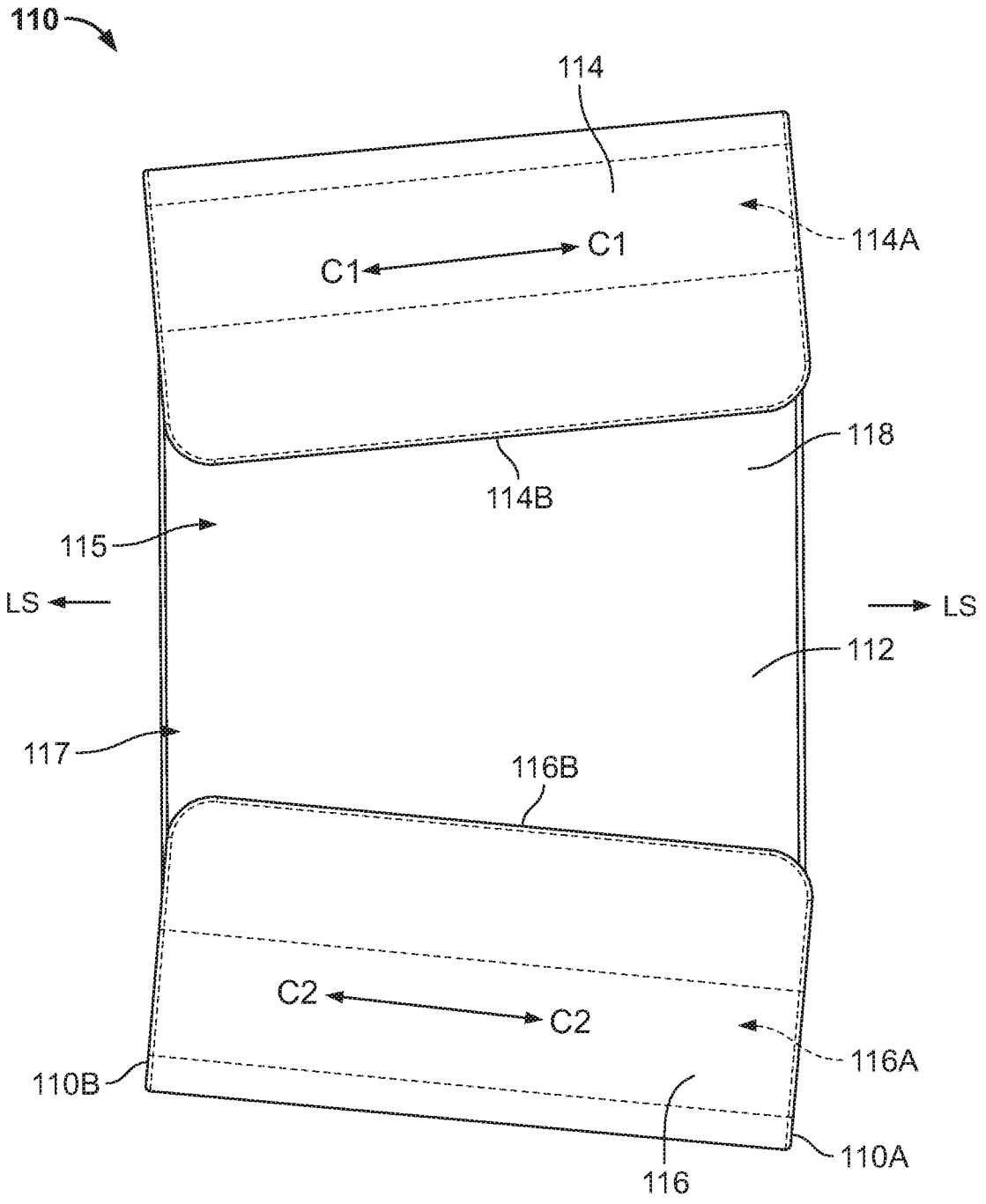
FIG. 7 is a side view of a sleeve member forming a part of the wedge connector system of FIG. 1.

The sleeve member 110 is C-shaped in cross-section. With reference to FIG. 7, the sleeve member 110 tapers inwardly from a rear end 110A to a front end 110B. The sleeve member 110 includes an arcuate first side wall or receiver or hook portion 114, an arcuate second side wall or receiver or hook portion 116, and a connecting portion or body 112 extending therebetween. The hook portions 114, 116 extend longitudinally along opposed side edges of the body 112. The sleeve member 110 further includes an inner surface 118. The sleeve member 110 forms a chamber or cavity 115 defined by the inner surface 118. In some embodiments, the sleeve member 110 is resiliently flexible.

The first hook portion 114 forms a concave first sleeve member cradle or channel 114A positioned at an end of the cavity 115. The first channel 114A is adapted to receive and make contact with the conductor 14 at an apex of the channel 114A. The first hook portion 114 forms a radial bend that wraps around the conductor 14 for about 180 circumferential degrees in an exemplary embodiment, such that a distal end 114B of the first hook portion 114 faces toward the second hook portion 116A.

Similarly, the second hook portion 116 forms a concave second sleeve member cradle or channel 116A positioned at an opposing end of the cavity 115 and opening to oppose the channel 114A. The second channel 116A is adapted to receive and make contact with the conductor 12 at an apex of the channel 116. The second hook portion 116 forms a radial bend that wraps around the conductor 12 for about 180 circumferential degrees in an exemplary embodiment, such that a distal end 116B of the second hook portion 116 faces toward the first hook portion 114.

The distal ends 114B and 116B define a longitudinally extending slot 117 therebetween that opens into the chamber 115.

With reference to FIG. 7, the sleeve member 110 has a lengthwise axis LS-LS. The first channel 114A defines a channel axis C1-C1. The second channel 116A defines a channel axis C2-C2. According to some embodiments and as illustrated, the channel axes C1-C1 and C2-C2 form an oblique angle relative to one another and, in some embodiments, the oblique angle is in the range of from about 10 to 12 degrees. According to some embodiments and as illustrated, the channel axes C1-C1 and C2-C2 form an oblique angle relative to the connector lengthwise axis L-L. When the connector assembly 100 is assembled, the channel axes C1-C1 and C2-C2 each extend transversely to and intersect the transverse axis M-M. According to some embodiments and as illustrated, the transverse axis M-M forms an oblique angle with each of the channel axes C1-C1 and C2-C2. The side channels 114A, 116A taper inwardly or converge from the rear end 110A to the front end 110B.

Figure 8:
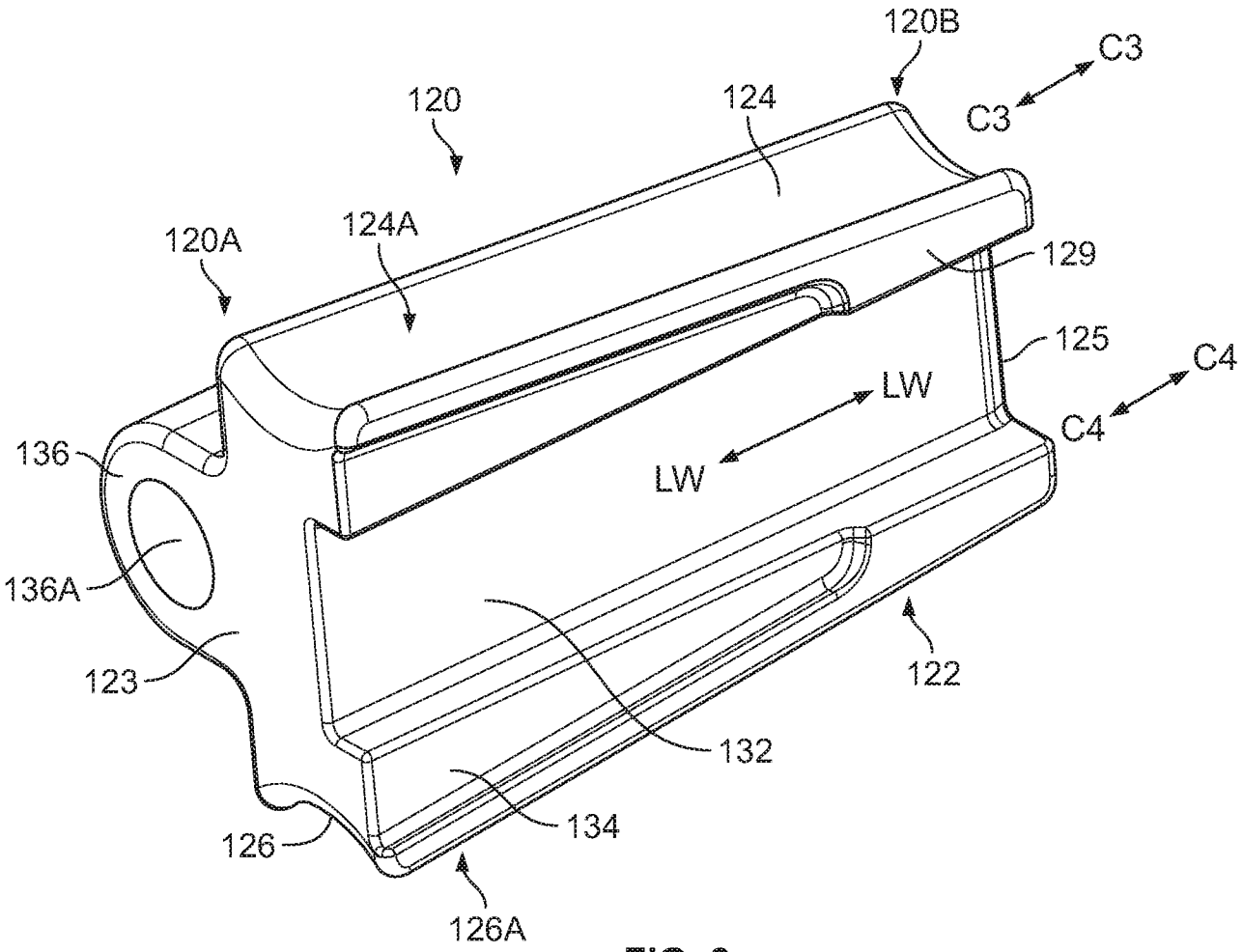
FIG. 8 is rear perspective view of a wedge member forming a part of the wedge connector system of FIG. 1.

With reference to FIGS. 1 and 8, the wedge member 120 includes a body 122 having opposed, arcuate clamping side faces or walls 124, 126, opposed end faces or walls 123, 125, and opposed outer and inner faces or walls 128, 129. The wedge member 120 tapers inwardly from a relatively wide rear end 120A to a relatively narrow front end 120B.

The clamping side walls 124, 126 define opposed, concave grooves or channels 124A, 126A. The channels 124A, 126A taper inwardly or converge from the rear end 120A to the front end 120B.

The wedge member 120 has a lengthwise axis LW-LW (FIG. 8). The channel 124A defines a channel axis C3-C3. The channel 126A defines a channel axis C4-C4. According to some embodiments and as illustrated, the channel axes C3-C3 and C4-C4 form an oblique angle relative to one another and, in some embodiments, the oblique angle is in the range of from about 10 to 12 degrees. According to some embodiments and as illustrated, the channel axes C3-C3 and C4-C4 form an oblique angle relative to the connector lengthwise axis L-L. When the connector assembly 100 is assembled, the channel axes C3-C3 and C4-C4 each extend transversely to and intersect the transverse axis M-M. According to some embodiments and as illustrated, the transverse axis M-M forms an oblique angle with each of the channel axes C3-C3 and C4-C4.

An axially extending alignment slot 130 is defined in the outer wall 128.

An axially extending guide slot 132 is defined in the inner wall 129. Opposed, axially extending bearing ribs may be located on either side of the slot 132. An axially extending deflection slot 134 is also defined in the inner wall 129 over and outward beyond the guide slot 132.

An integral boss 136 is located proximate the rear end 120A. The boss 136 projects outwardly from the body 122 in a direction transverse (e.g., perpendicular) to the connector axis L-L. A bore 136A extends through the boss 136 substantially parallel to the axis L-L. In some embodiments, the bore 136 is nonthreaded.

The lock mechanism includes a lock member 150, a first drive member 170, a cooperating second drive member 176, and a split ring washer 178. In some embodiments and as shown, the first drive member is a drive bolt 170 and the second drive member is a nut 176. The drive bolt 170 and the nut 176 operate as a clamping mechanism.

The retraction mechanism 181 includes a rear engagement portion 164 (on the rear end of the lock member 150), an annular retainer clip mount slot 179 (on the rear end of the drive bolt 170), and a retainer member, ring or clip 184.

With reference to FIGS. 1 and 5, the lock member 150 extends from a rear end 150A to a front end 150B along a lock member axis LC-LC. The lock member 150 includes a body 152, an integral bolt receiving portion 154, an integral guide rail 160, an integral hook or engagement portion 162, and an integral nut holder portion 168. The body 152 is located proximate the front end 150B and extends transversely to the axis LC-LC from an outer end 152A to an inner end 152B.

The bolt receiving portion 154 is located proximate the outer end 152A of the body 152 and extends rearwardly substantially parallel to the axis LC-LC. An extension portion 154A extends forwardly from the body 152. A bolt bore 156 extends through the bolt receiving portion 154. In some embodiments, the bore 156 is nonthreaded.

The guide rail 160 is located at a midsection of the body 152 and extends rearwardly substantially parallel to the axis LC-LC. The guide rail 160 is a substantially flat, elongate plate. An integral, axially extending bearing rib may be located on the outer face of the guide rail.

The engagement portion 162 includes a sleeve slot 166 (FIG. 5).

The nut holder portion 168 includes a cavity 168B and a side opening 168A communicating with the cavity 168B. Anti-rotation features in the form of flats 168C (FIG. 5) are located in the cavity 168B.

The bolt 170 (FIG. 1) has an externally threaded cylindrical shank, rod or shaft 172 and an integral driver engagement feature 174 on the rear end of the shaft 172. The driver engagement feature 174 may be provided in the form of a geometric head (e.g., a hexagonal faceted head) or a geometric socket. The drive head 174 may be a hex head as illustrated, for example.

The annular retainer clip mount slot 179 is defined in the outer surface of the bolt 170 proximate the head 174. The retainer clip 184 is seated in the slot 179. The retainer clip 184 is thereby positioned on rear side of the boss 136, opposite the bolt head 174. The retainer clip 184 permits the bolt 170 to rotate about the bolt's lengthwise axis within and relative to the boss 136, but limits relative forward axial displacement of the bolt 170 relative to the boss 136. In this way, the retainer clip 184 prevents the bolt from moving forwardly out of the boss 136 beyond a relatively short prescribed distance.

The nut 176 includes an internally threaded bore 176A and outer geometric engagement facets or faces 176B. For example, the nut 176 may be a hex nut, as illustrated.

The sleeve member 110 may be formed of any suitable electrically conductive material. According to some embodiments, the sleeve member 110 is formed of metal. According to some embodiments, the sleeve member 110 formed of aluminum or steel. The sleeve member 110 may be formed using any suitable technique. According to some embodiments, the sleeve member 110 is monolithic and unitarily formed. According to some embodiments, the sleeve member 110 is extruded and cut. Alternatively or additionally, the spring sleeve 110 may be stamped (e.g., die-cut), cast and/or machined.

The wedge member 120 may be formed of any suitable material. According to some embodiments, the wedge member 120 is formed of metal. According to some embodiments, the wedge member 120 is formed of aluminum or copper alloy. The wedge member 120 may be formed using any suitable technique. According to some embodiments, the wedge member 120 is cast and/or machined.

The lock member 150 may be formed of any suitable material. According to some embodiments, the lock member 150 is formed of metal. According to some embodiments, the lock member 150 is formed of aluminum or copper alloy. The clamping member 150 may be formed using any suitable technique. According to some embodiments, the lock member 150 is cast and/or machined.

The sleeve member 110, the wedge member 120, and the lock member 150 may be separately fabricated from one another or otherwise formed into discrete connector components and are assembled to one another as explained below. While exemplary shapes of these components have been illustrated herein, it is recognized that they may be alternatively shaped in other embodiments as desired.

The bolt 170, the nut 176, and the retainer clip 184 may be formed of any suitable material. According to some embodiments, the bolt 170, the nut 176, and the retainer clip 184 are formed of metal. According to some embodiments, the bolt 170, the nut 176, and the retainer clip 184 are formed of aluminum or steel.

With reference to FIGS. 2-6, exemplary methods for assembling and using the connector assembly 100 in accordance with embodiments of the present invention will now be described.

The sleeve member 110, the wedge member 120, the lock member 150, the bolt 170, the nut 176, the washer 178, and the retainer clip 184 may each be manufactured as individual, discrete parts from the others, and thereafter assembled together. Each of the assembly steps may be executed in a factory or by an end user or installer.

Figure 2:
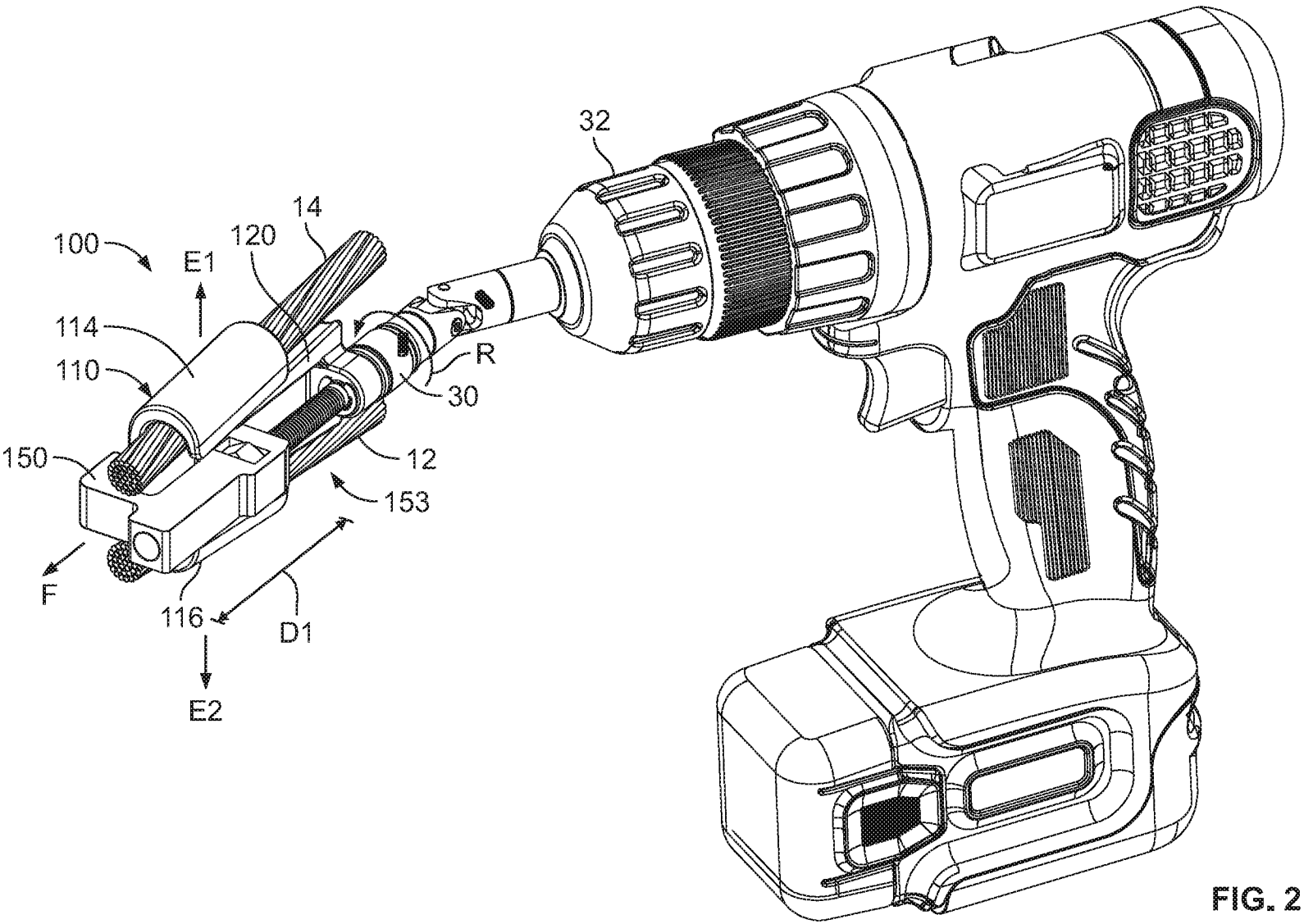
FIG. 2 is a front perspective view of the wedge connector system of FIG. 1 illustrating installation of the wedge connector system on the conductors.

The wedge member 120, the lock member 150, the bolt 170, the nut 176 the washer 178, and the retainer clip 184 are assembled together to form a wedge subassembly 153 (FIG. 2). More particularly, the guide rail 160 is slid into the guide slot 132 from the front end 120B. The nut 176 is inserted through the opening 168A and seated in the cavity 168B. The shaft 172 of the bolt 170 is inserted through the bore 136A and threadedly engages with the nut 176. The nut 176 is prevented from rotation with the bolt 170 by the flats 168C. The retainer clip 184 is installed in the slot 179 to axially secure or limit the bolt 170 relative to the wedge member 120. The bolt 170 may be adjusted so that the guide rail 160 is captured in the guide slot 132 and the wedge subassembly 153 will maintain the arrangement as shown in FIG. 2.

In some embodiments, the wedge subassembly 153 is assembled at the factory and provided to the end user or installer assembled. In other embodiments, the wedge subassembly 153 is assembled by the end user and, in some embodiments, is assembled onsite at the location of the tap installation by the installer. The wedge subsassembly 153 can assume an open position (as shown in FIG. 2) wherein the wedge member 120 is extended and the front end 120B of the wedge member 120 is spaced a distance D1 (FIG. 2) from the front end 150B of the lock member 150. The wedge subsassembly 153 can alternatively assume a closed position (as shown in FIGS. 3-6) wherein the wedge member 120 is retracted and the front end 120B of the wedge member 120 is spaced a distance D2 (FIG. 5) from the front end 150B of the lock member 150. The distance D2 is less than the distance D1.

As shown in FIG. 2, the C-shaped sleeve member 110 is placed over the conductor 12 such that the conductor 12 is received in the side channel 116A. The conductor 14 is placed in the other side channel 114A.

With the wedge subassembly 153 in the open position, the wedge subassembly 153 is laterally inserted into the sleeve member cavity 115 through the slot 117. The wedge member 120 is partially inserted into the cavity 115 between the conductors 12, 14 such that the conductors 12, 14 are received in the opposed grooves 124A, 126A. The wedge member 120 may be forced into the sleeve member 110 by hand or using a hammer or the like to temporarily hold the wedge member 120 and the conductors 12, 14 in position.

The tool 30 is engaged with the bolt head 174. Advantageously, the head 174 is accessible for engagement with the tool 30 from the rear side of the wedge assembly 153. The tool 30 is forcibly driven by the driver 32 to rotate the bolt 170 in a direction R relative to the fixed nut 176. The wedge member 120 and the lock member 150 are thereby linearly displaced and pulled together in opposed converging directions toward the closed position of the wedge subassembly 153. The wedge member 120 abuts the conductors 12, 14 in the sleeve member 110 and the lock member 150 hooks over and receives the front end 110B of the sleeve member 110 in the slot 166.

The driver 32 and tool 30 are further used to forcibly rotate the bolt 170 so that the wedge member 120 is further forced forwardly (direction F, FIG. 2) relative to the sleeve member 110 until the wedge member 120 is in a desired final position to form the connection 10 as shown in FIGS. 3-6. The connection 10 may be formed by forming interference fits between the wedge member 120, the C-shaped sleeve member 110 and the conductors 12, 14. Moreover, the wedge member 120 is secured in place by the interlocking engagement between the engagement portion 162 and the sleeve member 110.

During installation, the engagement portion 162 locks onto the front end 110B of the sleeve member 110 and maintains proper alignment between the wedge member 120 and the sleeve member 110. This interlock may also act as a safety feature at the beginning stages of the installation.

The wedge member 120, the sleeve member 110 and/or the conductors 12, 14 may be deformed. The C-shaped sleeve member 110 may be elastically deformed so that it applies a bias or spring force against the wedge member 120 and the conductors 12, 14. The sleeve member 110 may be plastically deformed.

In some embodiments, the hook portions 114, 116 are deflected outward (in directions E1 and E2 (FIG. 2), respectively) along the transverse axis M-M. The sleeve member 110 is elastically and plastically deflected resulting in a spring back force (i.e., from stored energy in the bent sleeve member 110) to provide a clamping force on the conductors 12, 14. As a result of the clamping force, the sleeve member 110 may generally conform to the conductors 12, 14. According to some embodiments, a large application force, on the order of about 26 to 31 kN of clamping force is provided, and the clamping force ensures adequate electrical contact force and electrical connectivity between the connector assembly 100 and the conductors 12, 14. Additionally, elastic deflection of the sleeve member 110 provides some tolerance for deformation or compressibility of the conductors 12, 14 over time, such as when the conductors 12, 14 deform due to compression forces. Actual clamping forces may be lessened in such a condition, but not to such an amount as to compromise the integrity of the electrical connection.

In some embodiments, the elastic deflection of the sleeve member 110 causes the central body 112 to bend or bulge toward the wedge member 120, where a portion of the body 112 is received in the deflection slot 134.

In some embodiments, the outer surface of the bolt receiver portion 154 is lubricated to reduce friction with the wedge member 120 in the alignment slot 130.

The tubular bolt receiving portion 154, including the extension portion 154A, covers the bolt shaft 172 after termination.

Once installed, the connector system 101 can be operated as follows to disassemble the connection and connection assembly 100 in accordance with methods of the invention. The bolt 170 is rotated opposite the direction R (i.e., counterclockwise) to force the wedge member 120 to move axially rearwardly and away from the bolt head 174. Because the axial position of the retainer clip 184 on the bolt 170 is fixed and the rear engagement portion 164 prevents relative axial displacement between the lock member 150 and the sleeve member 110, the bolt rotation force displaces the wedge member 120 rearwardly (direction E in FIG. 5) relative to the sleeve member 110. In this way, the sleeve member 110 and the wedge member 120 are freed from one another and the connection. The lock bar 150 can then be removed from the sleeve member 110.

Any suitable type or construction of driver 32 may be used to forcibly rotate the bolt 170 in the rotation direction R. According to some embodiments, the bolt 170 is rotated using a power tool. The power tool may be an electrically, pneumatically or hydraulically powered tool. According to some embodiments, the power tool is a battery powered tool. According to some embodiments, the tool 30 is rotated using a manual driver.

A corrosion inhibitor compound may be provided (i.e., applied at the factory) on the conductor contact surfaces of the wedge member 120 and/or the sleeve member 110. The corrosion inhibitor may prevent or inhibit corrosion formation and assist in abrasion cleaning of the conductors 12, 14. The corrosion inhibitor can inhibit corrosion by limiting the presence of oxygen at the electrical contact areas. The corrosion inhibitor material may be a flowable, viscous material. The corrosion inhibitor material may be, for example, a base oil with metal particles suspended therein. In some embodiments, the corrosion inhibitor is a cod oil derivative with aluminum nickel alloy particles. Suitable inhibitor materials are available from TE Connectivity.

According to some embodiments, the corrosion inhibitor layer has a thickness in the range of from about 0.02 to 0.03 inch.

It will be appreciated that the connector assembly 100 can effectively accommodate conductors 12, 14 of a range or different sizes and configurations as a result of the flexibility of the spring member 110. Different connector assemblies 100 can themselves be sized to accommodate different ranges of conductor sizes, from relatively small diameter wires for low current applications to relatively large diameter wires for high voltage energy transmission applications. In some embodiments, the size of the main conductor 14 is 336.4 kcmil or greater and the size of the tap conductor 12 is #6 AWG or greater.

It is recognized that effective clamping force on the conductors 12, 14 is dependent upon the geometry and dimensions of the members 110, 120 and size of the conductors used with the connector assembly 100. Thus, with strategic selections of angles for the engagement surfaces, and the size and positioning of the conductors 12, 14, varying degrees of clamping force may be realized when the connector assembly 100 is used as described above.

As illustrated, the channels 114A, 116A are generally arcuate. However, some or all of the channels 114A, 116A may have cross-sectional shapes of other configurations.

Elongate, protruding ribs may be provided in the channels 124A, 126A to reduce friction as the wedge member 120 is driven into the sleeve member 110. The ribs typically will not significantly reduce electrical contact surface with the conductors 12, 14. According to some embodiments, each rib has a height in the range of from about 0.008 to 0.012 inch and a width in the range of from about 0.018 to 0.022 inch.

Figure 9:
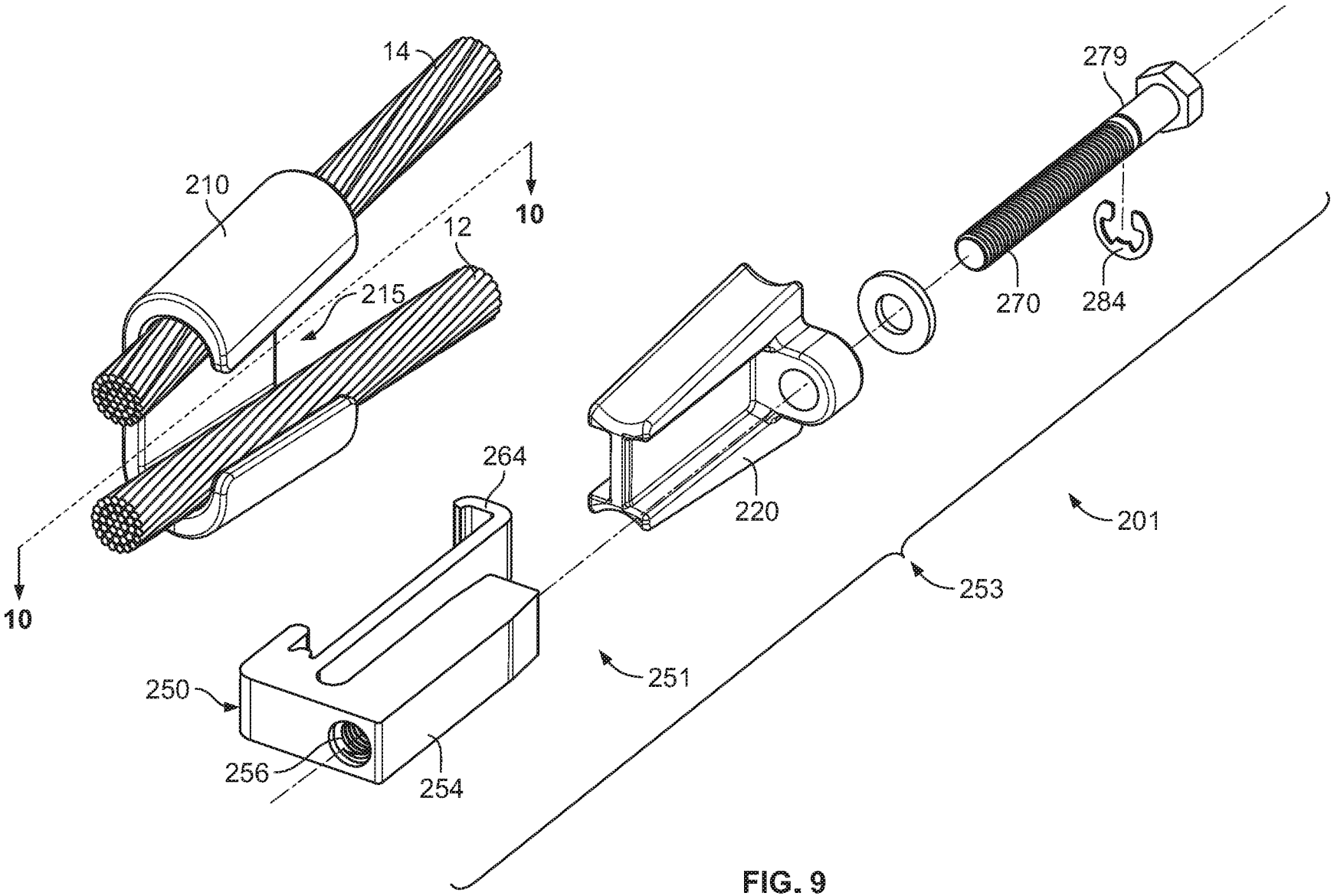
FIG. 9 is an exploded, front perspective view of a wedge connector system according to further embodiments of the invention and a pair of conductors.
Figure 10:
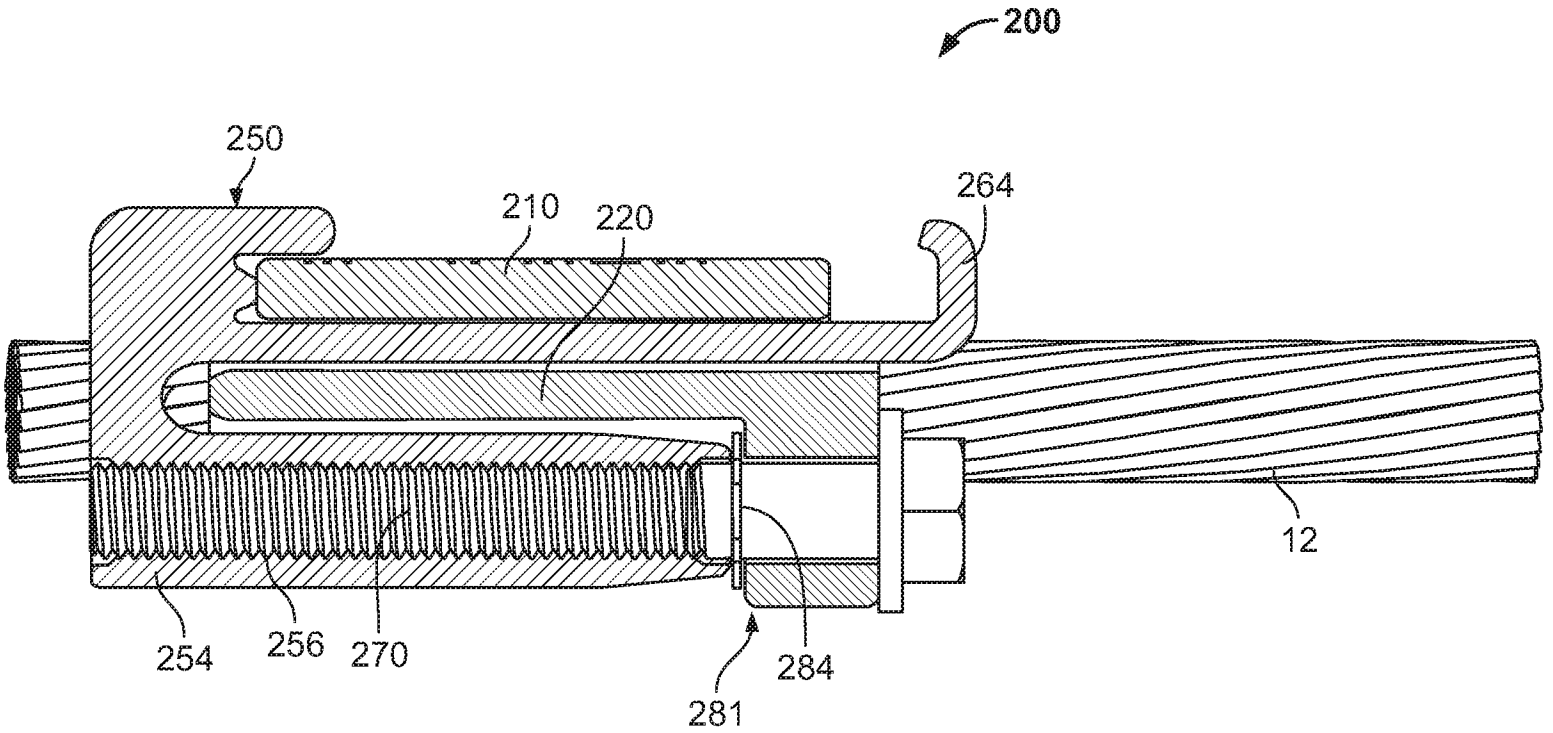
FIG. 10 is a cross-sectional view of the wedge connector assembly of FIG. 9 taken along the line 10-10 of FIG. 9.

With reference to FIGS. 9 and 10, a wedge connector system 201 and a wedge connector assembly 200 according to further embodiments is shown therein. The connector assembly 200 corresponds to and may be used in the same manner as the connector assembly 100, except as discussed below. The connector assembly 200 includes a sleeve member 210 and a wedge member 220, corresponding to the sleeve member 110 and a wedge member 120, respectively.

The connector assembly 200 further includes a drive/lock mechanism 251 corresponding to the drive/lock mechanism 151 except as follows. In place of the nut 176 and the nut holder portion 168, the lock member 250 is provided with an internally threaded bore 256 in its bolt receiver portion 254. In use, a wedge subassembly 253 is formed by threadedly engaging the bolt 270 with the threaded bore 256. The wedge subassembly 253 can then be installed on the sleeve member 210 and the conductors 12, 14. The wedge subassembly 253 can be contracted by rotating the bolt head 274 to clamp the wedge subassembly 253 onto the sleeve member 210 and force the wedge member 220 into the sleeve member cavity 215 to mechanically capture the conductors 12, 14 therebetween and electrically connect the conductors 12, 14 to one another. The rear end of the bolt receiver portion 254 can serve as a stop face to limit wedge member travel.

The connector assembly 200 also includes a retraction mechanism 281 corresponding to the retraction mechanism 181. The retraction mechanism 281 includes a rear engagement portion 264 (on the rear end of the lock member 250), an annular retainer clip mount slot 279 (on the rear end of the drive bolt 270), and a retainer member, ring or clip 284. The connector assembly 200 can be disassembled and removed in the same manner as described above for the connector assembly 100.

Figure 11:
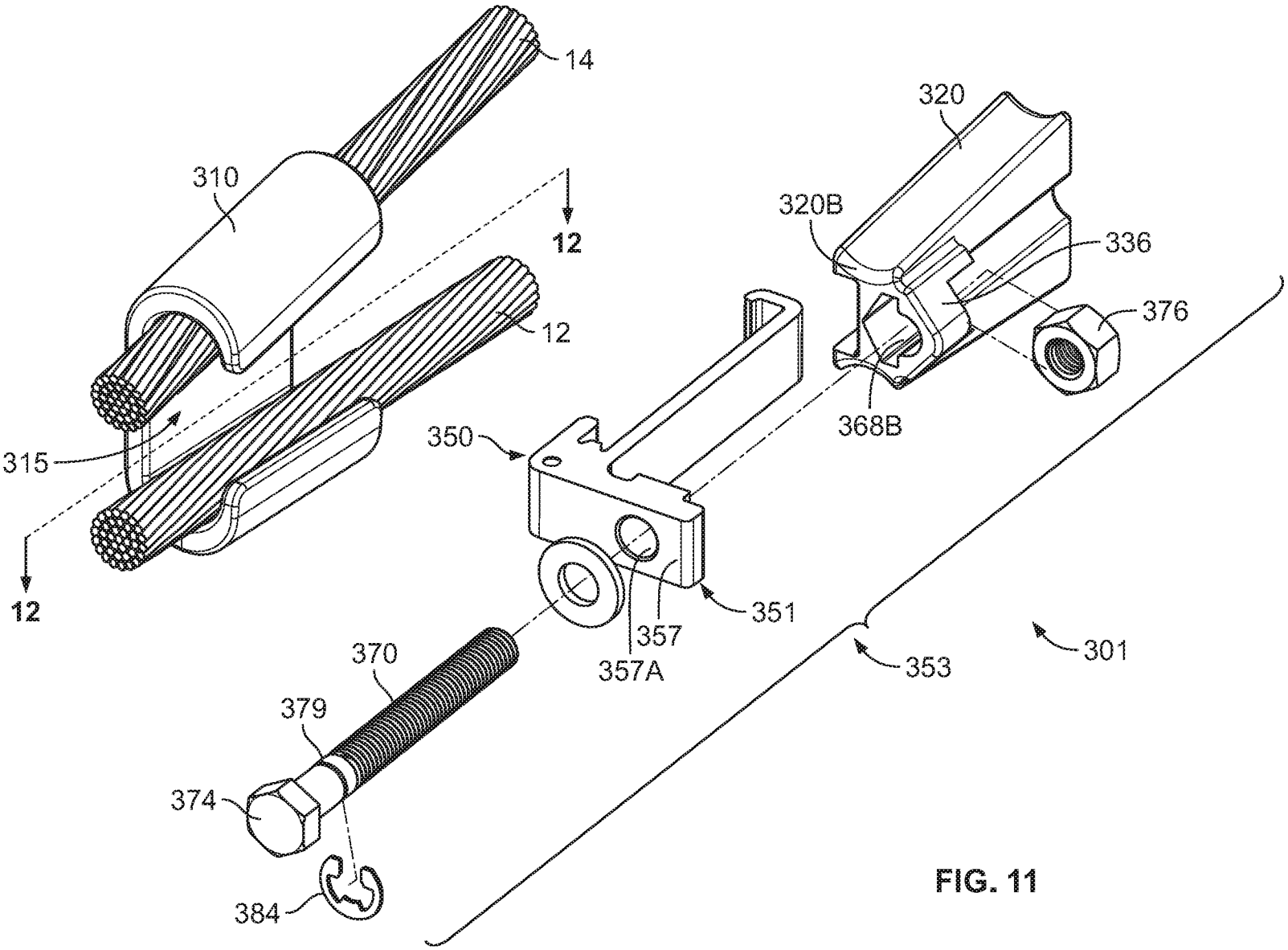
FIG. 11 is an exploded, front perspective view of a wedge connector system according to further embodiments of the invention and a pair of conductors.
Figure 12:
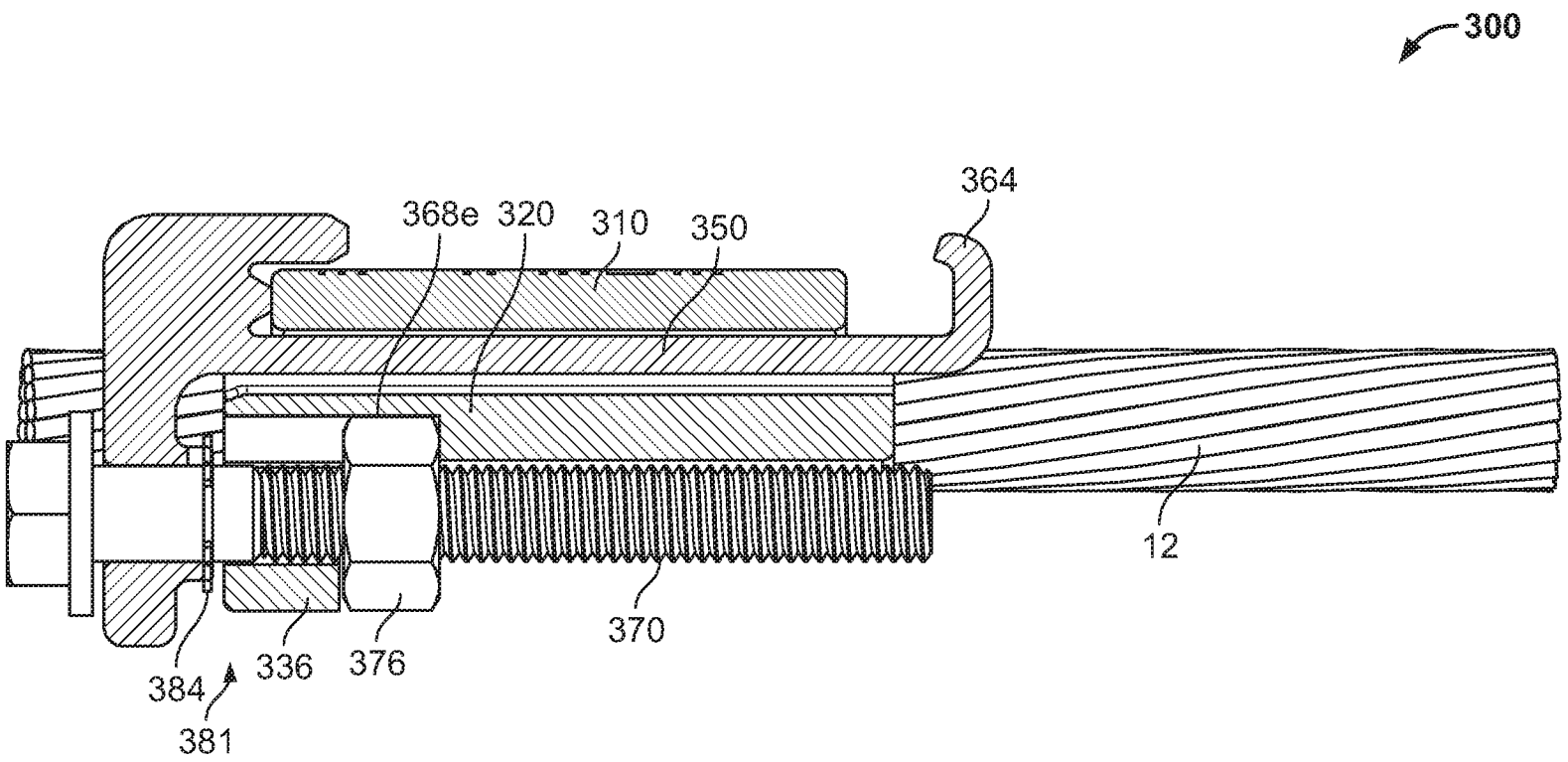
FIG. 12 is a cross-sectional view of the wedge connector assembly of FIG. 11 taken along the line 12-12 of FIG. 11.

With reference to FIGS. 11 and 12, a wedge connector system 301 and a connector assembly 300 according to further embodiments is shown therein. The connector assembly 300 corresponds to and may be used in the same manner as the connector assembly 100, except as discussed below. The connector assembly 200 includes a sleeve member 310 corresponding to the sleeve member 110. The connector assembly 300 further includes a drive/lock mechanism 351 corresponding to the drive/lock mechanism 151 except as discussed below.

The connector assembly 300 includes a wedge member 320 corresponding to the wedge member 120 except that the wedge member 320 is provided with a boss 336 on its front end 320B. The boss 336 includes a nut slot 368B having anti-rotation features 368C. The nut 376 is seated in the nut slot 368B.

The connector assembly 300 further includes a lock member 350 corresponding to the lock member 150 except that the lock member 150 is provided with bolt receiving arm 357 and a bore 357A.

In use, a wedge subassembly 353 is formed by inserting the bolt 370 through the bore 357A and threadedly engaging the bolt 370 with the nut 376. The wedge subassembly 353 can then be installed on the sleeve member 310 and the conductors 12, 14. The wedge subassembly 353 can be contracted by engaging the bolt head 374 and rotating the bolt 370 to clamp the wedge subassembly 353 onto the sleeve member 310 and force the wedge member 320 into the sleeve member cavity 315 to mechanically capture the conductors 12, 14 therebetween and electrically connect the conductors 12, 14 to one another. It will be appreciated that in the case of the connector assembly 300, the bolt head 374 is engaged by the tool 30 from the front end of the wedge subassembly 353.

The connector assembly 300 also includes a retraction mechanism 381 corresponding to the retraction mechanism 181. The retraction mechanism 381 includes a rear engagement portion 364 (on the rear end of the lock member 350), an annular retainer clip mount slot 379 (on the rear end of the drive bolt 370), and a retainer member, ring or clip 384. The connector assembly 300 can be disassembled and removed in the same manner as described above for the connector assembly 100.

Figure 13:
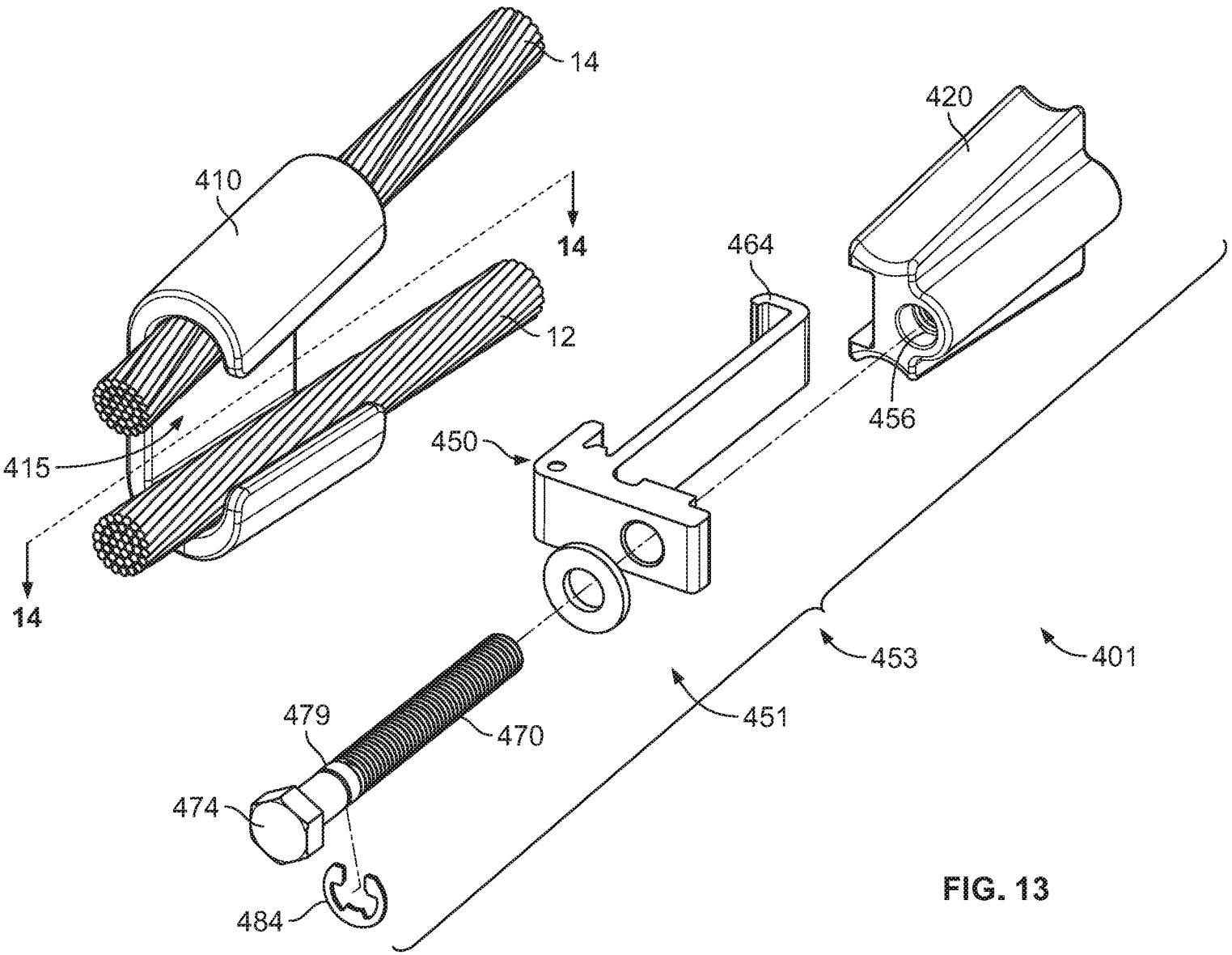
FIG. 13 is an exploded, front perspective view of a wedge connector system according to further embodiments of the invention and a pair of conductors.
Figure 14:
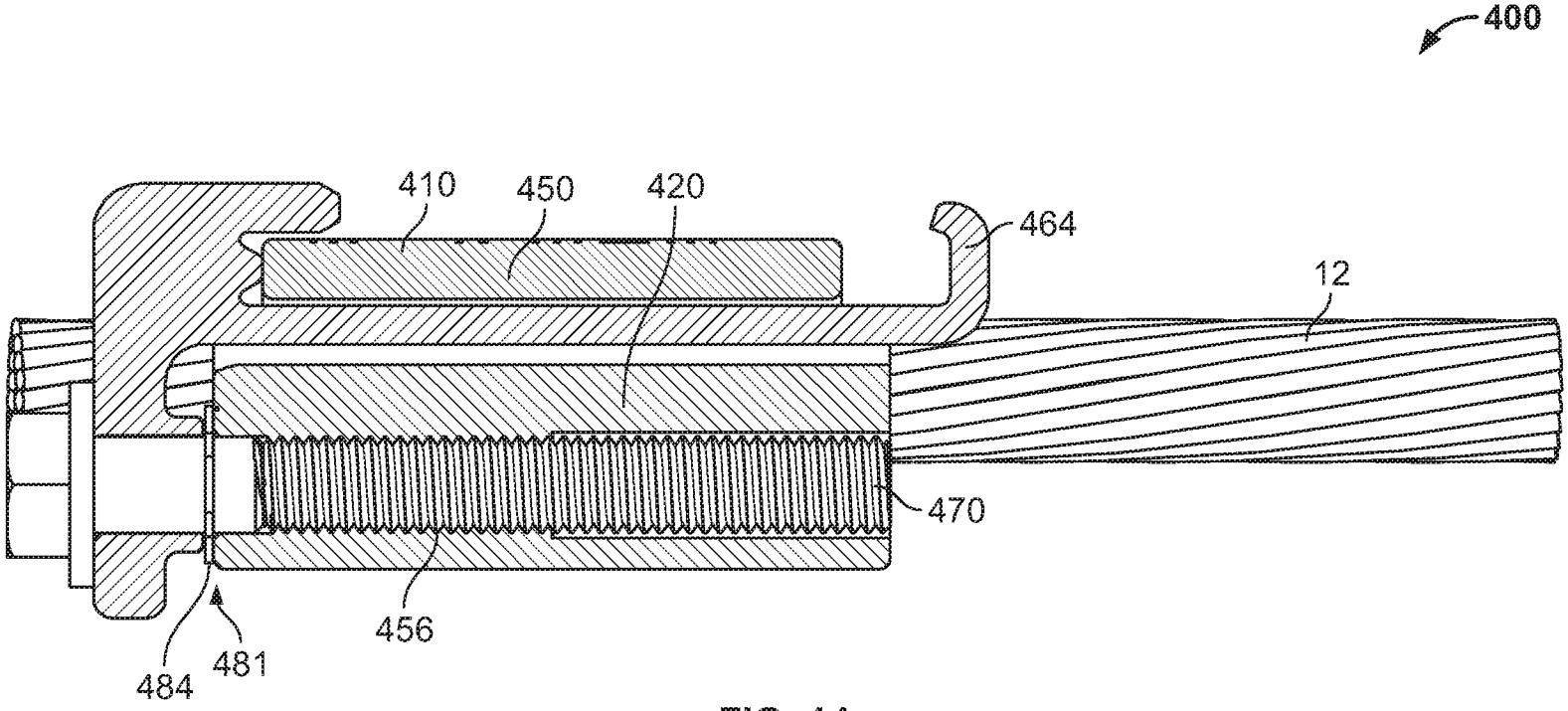
FIG. 14 is a cross-sectional view of the wedge connector assembly of FIG. 13 taken along the line 14-14 of FIG. 13.
Figure 15:
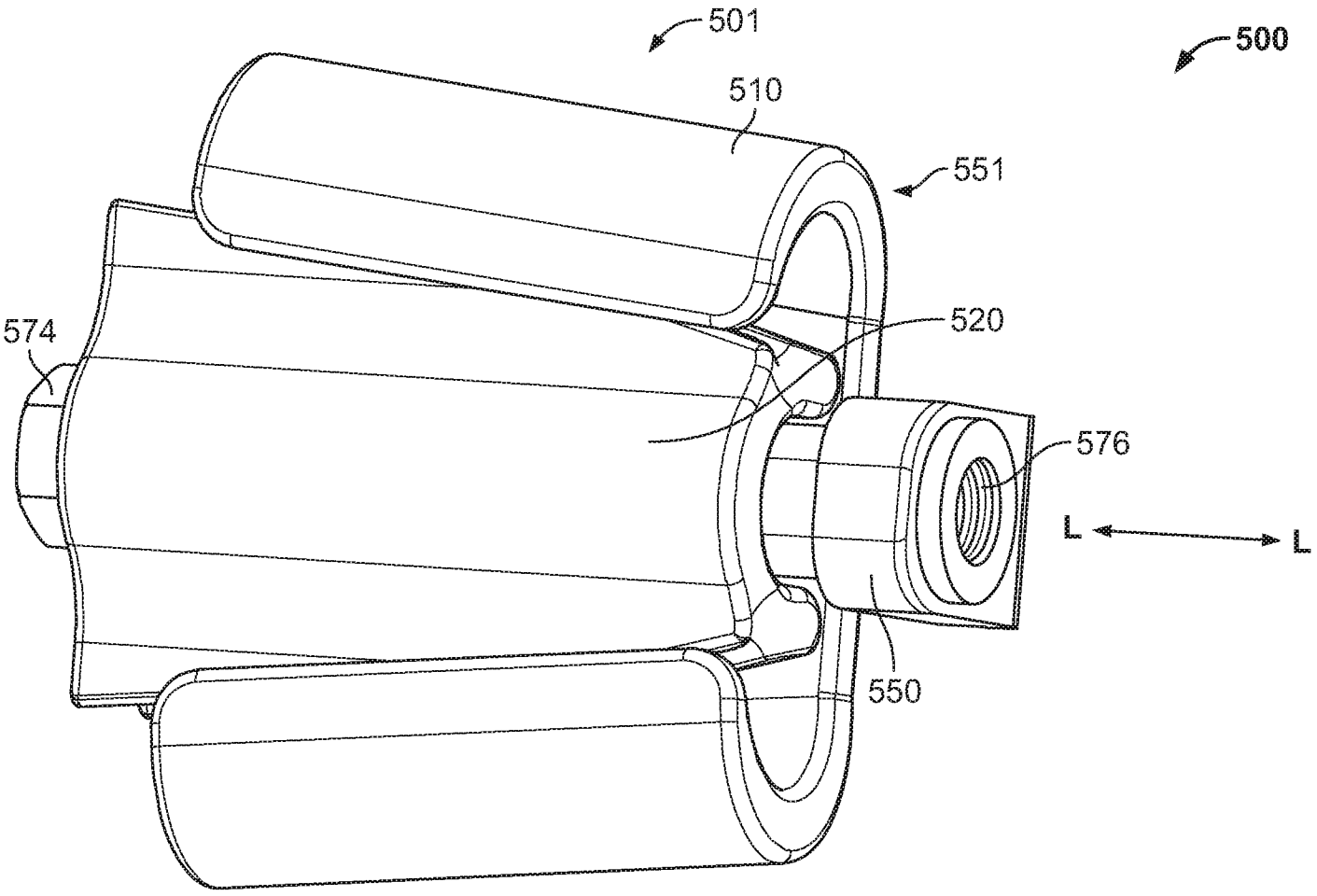
FIG. 15 is a front perspective view of a wedge connector system and wedge connector assembly according to further embodiments of the invention.
Figure 16:
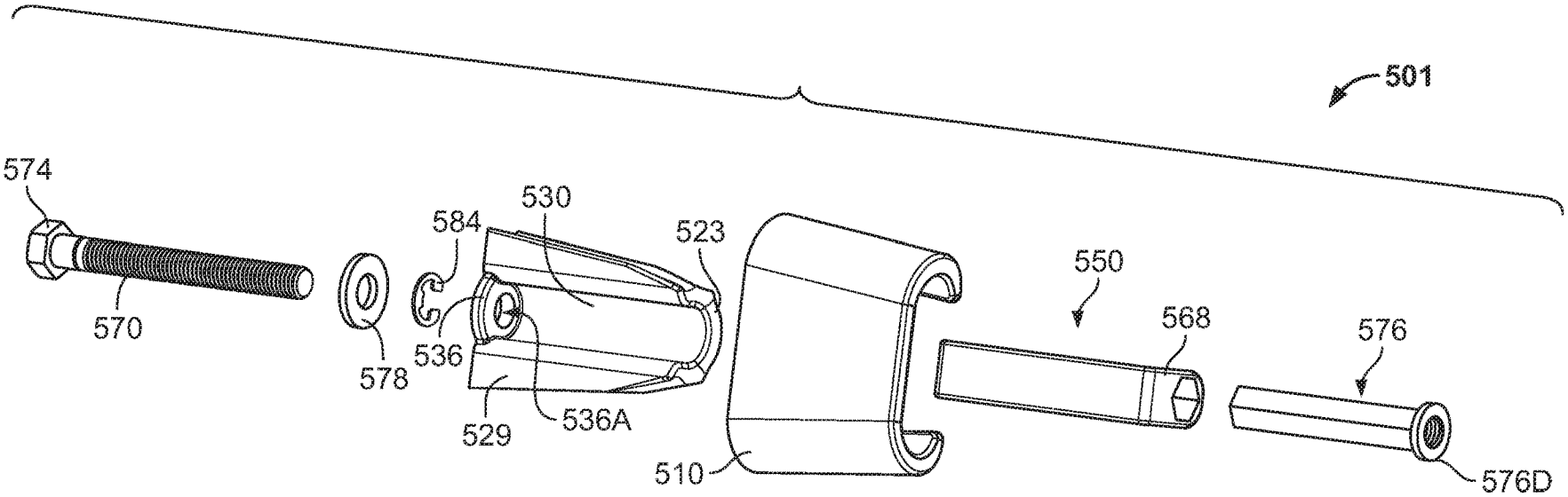
FIG. 16 is an exploded, front perspective view of the wedge connector system of FIG. 15.
Figure 17:
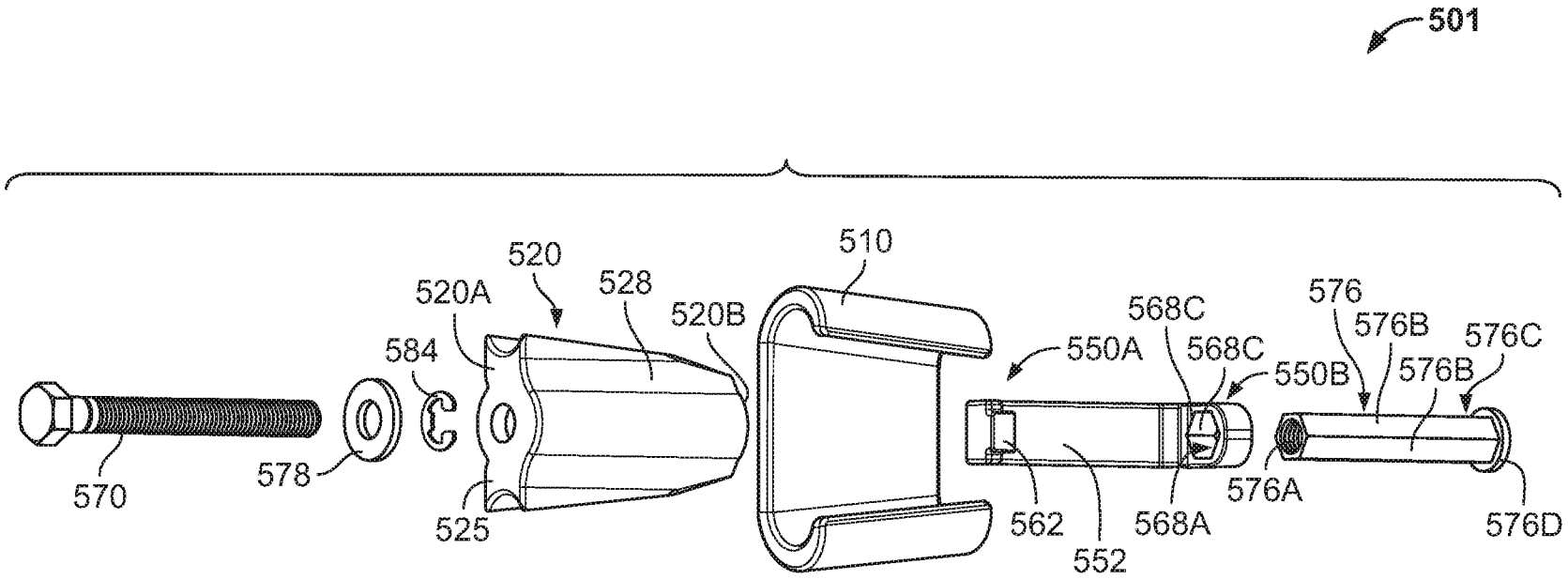
FIG. 17 is an exploded, rear perspective view of the wedge connector system of FIG. 15.
Figure 18:
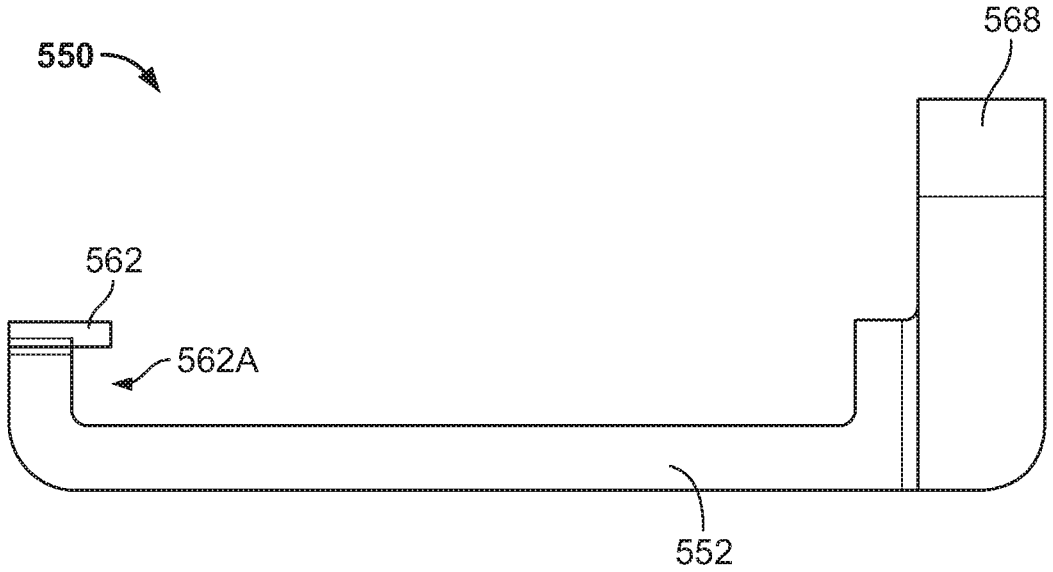
FIG. 18 is a side view of a lock member forming a part of the wedge connector system of FIG. 15.
Figure 19:
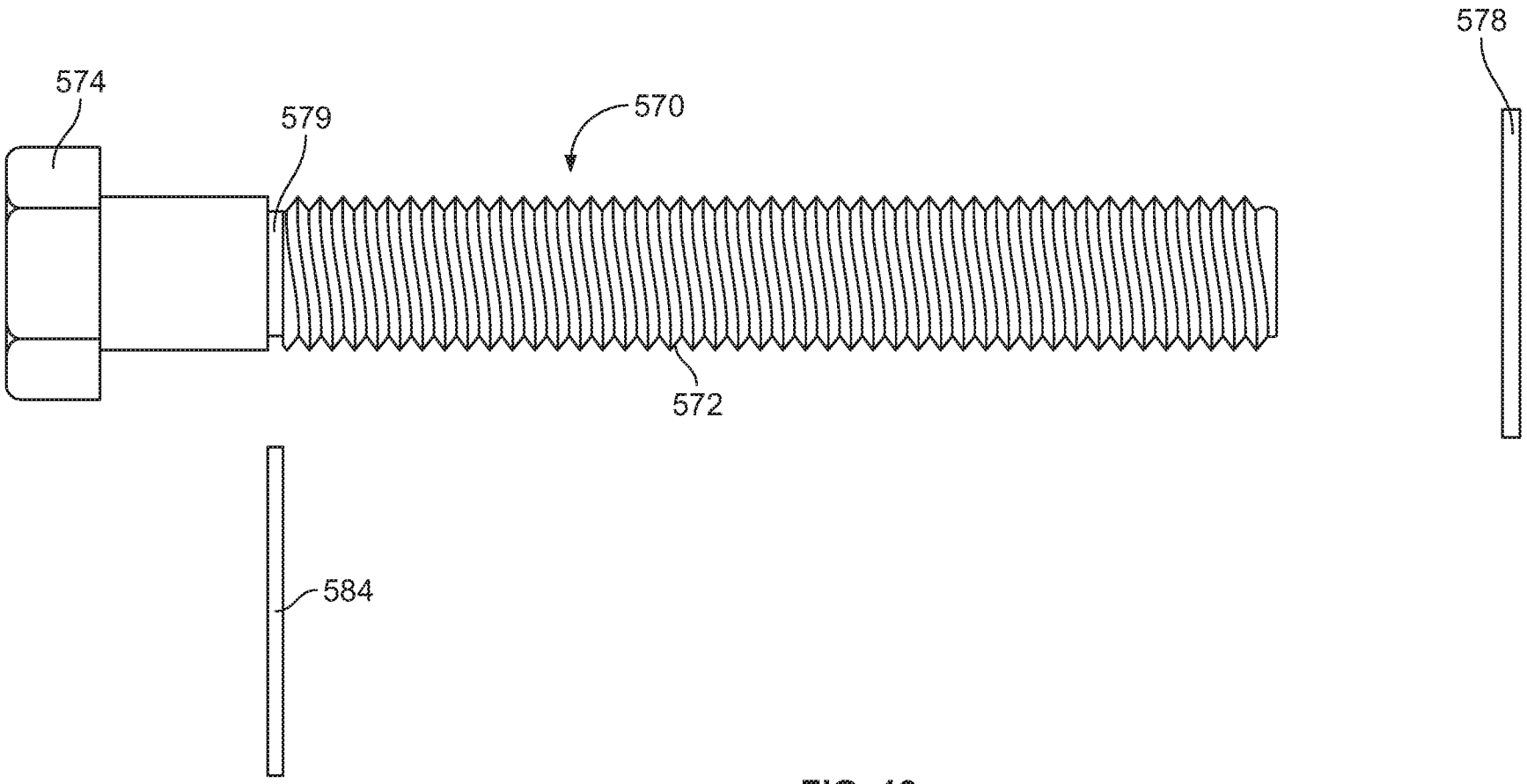
FIG. 19 is a side view of a drive bolt and a retainer clip forming a part of the wedge connector system of FIG. 15.

With reference to FIGS. 13 and 14, a wedge connector system 401 and a wedge connector assembly 400 according to further embodiments is shown therein. The connector assembly 400 corresponds to and may be used in the same manner as the connector assembly 300, except as discussed below. The connector assembly 400 includes a sleeve member 310 corresponding to the sleeve member 110.

The connector assembly 400 further includes a drive/lock mechanism 451 corresponding to the drive/lock mechanism 351 except as follows. In place of the nut 376 and the nut holder slot 368B, the wedge member 420 is provided with an internally threaded bore 456. In use, a wedge subassembly 453 is formed by threadedly engaging the bolt 470 with the threaded bore 456. The wedge subassembly 453 can then be installed on the sleeve member 410 and the conductors 12, 14. The wedge subassembly 453 can be contracted by engaging the bolt head 474 to rotate the bolt 470 to clamp the wedge subassembly 453 onto the sleeve member 410 and force the wedge member 420 into the sleeve member cavity 415 to mechanically capture the conductors 12, 14 therebetween and electrically connect the conductors 12, 14 to one another.

The connector assembly 400 also includes a retraction mechanism 481 corresponding to the retraction mechanism 181. The retraction mechanism 481 includes a rear engagement portion 464 (on the rear end of the lock member 350), an annular retainer clip mount slot 479 (on the rear end of the drive bolt 470), and a retainer member, ring or clip 484. The connector assembly 400 can be disassembled and removed in the same manner as described above for the connector assembly 100.

With reference to FIGS. 15-22, a wedge connector system 501 and a wedge connector assembly 500 according to further embodiments is shown therein. The connector assembly 500 corresponds to and may be used in the same manner as the connector assembly 100, except as discussed below. The connector assembly 500 includes a sleeve member 510 and a wedge member 520, corresponding to the sleeve member 110 and the wedge member 120, respectively. The connector assembly 500 includes a drive/lock mechanism 551. The sleeve member 510 and the wedge member 520 are movable relative to one another to cooperatively mechanically capture the conductors 12, 14 therebetween and electrically connect the conductors 12, 14 to one another.

The wedge member 520 includes a body 522 having opposed, arcuate clamping side faces or walls 524, 526, opposed end faces or walls 523, 525, and opposed outer and inner faces or walls 528, 529. The wedge member 520 tapers inwardly from a relatively wide rear end 520A to a relatively narrow front end 520B.

An axially extending alignment slot 530 is defined in the inner wall 529.

An integral boss 536 is located proximate the rear end 520A. The boss 536 projects outwardly from the body 522 in a direction transverse (e.g., perpendicular) to the connector axis L-L and toward the sleeve member 510. A bore 536A extends through the boss 536 substantially parallel to the axis L-L. In some embodiments, the bore 536A is nonthreaded.

The lock mechanism 551 includes a lock member 550, a first drive member 570, a cooperating second drive member 576, a washer 578, and a retainer clip 584. In some embodiments and as shown, the first drive member is a drive bolt 570 and the second drive member is a nut 576. The drive bolt 570 and the nut 576 operate as a clamping mechanism.

The lock member 550 extends from a rear end 550A to a front end 550B along a lock member axis LC-LC. The lock member 550 includes a longitudinally extending body 552, an integral rear engagement or hook portion 562, and an integral nut holder portion 568.

The hook portion 562 is located on the rear end 550A. The hook portion 562 defines a slot 562A.

The nut holder portion 568 is a boss located on the front end 550B and projects laterally away from the connecting wall 512 of the sleeve member 510. The nut holder portion 568 includes a bore 568A. Anti-rotation features in the form of flats 568C are located in the bore 568A and define a hexagonal passage.

The bolt 570 has an externally threaded cylindrical shank, rod or shaft 572 and an integral driver engagement feature 574 on the rear end of the shaft 572. The driver engagement feature 574 may be provided in the form of a geometric head (e.g., a hexagonal faceted head) or a geometric socket. The drive head 574 may be a hex head as illustrated, for example.

An annular retainer ring mount slot 579 is defined in the outer surface of the bolt 570 proximate the head 574. The retainer clip 584 is seated in the slot 579. The retainer clip 584 is thereby positioned on front side of the boss 536, opposite the bolt head 574. The retainer clip 584 permits the bolt 570 to rotate about the bolt's lengthwise axis relative to the boss 536, but limits relative rearward axial displacement of the bolt 570 relative to the boss 536. In this way, the retainer clip 584 prevents the bolt from moving rearwardly out of the boss 536 beyond a relatively short prescribed distance. Other retention devices (e.g., a split pin) or features may be used in addition to or in place of the retainer clip 584 to axially constrain the bolt 570 relative to the wedge member 520 while permitting the bolt 570 to rotate relative to the wedge member 520.

The nut 576 is an extended or elongate capped coupling nut. The nut 576 has a nut body 576C and an internally threaded bore 576A. The outer surface of the nut body 576C has geometric engagement facets or faces 576B and is hexagonal in cross-section. The nut 576 also has a stop feature 576D on the capped end of the body 576C having an outer diameter greater than that of the nut body 576C. The nut 576 is seated in the bore 568A of the lock member 550 such that the faceted outer surface of the nut 576 mates with the complementary faceted inner surface of the bore 568A to prevent or limit rotation of the nut 576 relative to the bore 568A. The nut body 576C may fit closely in the bore 568A, but is permitted to slide axially through the bore 568A. The stop feature 576D is sized to prevent it from passing through the bore 568A.

The sleeve member 510, wedge member 520, lock member 550, bolt 570, and nut 576 may be formed of materials and using techniques as described above for the sleeve member 110, wedge member 120, lock member 150, bolt 170, and nut 176.

Exemplary methods for assembling and using the connector assembly 500 in accordance with embodiments of the present invention will now be described.

Figure 20:
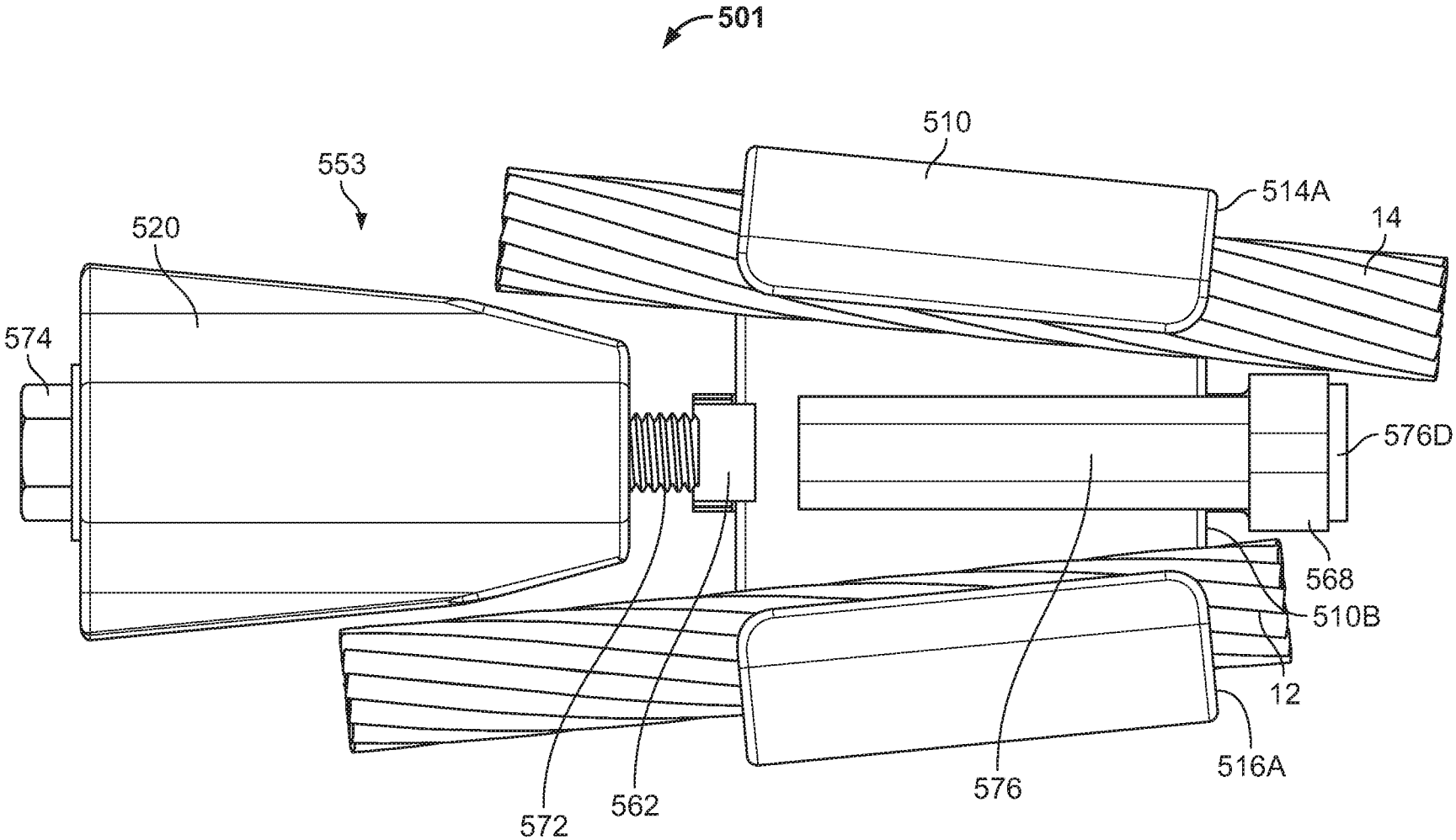
FIG. 20 is side view of the wedge connector system of FIG. 15 mounted on a pair of conductors, wherein the wedge connector system is in an open position.

In order to assemble the wedge connector assembly 500, the lock member 550 is mounted on the sleeve member 510 as shown in FIG. 20 such that the rear edge of the sleeve member 510 is received and captured in the slot 562A. The lock member body 552 extends along the outside of the sleeve member connecting portion 512. The boss 568 is positioned at the front end 510B of the sleeve member 510.

The nut 576 is inserted through the bore 568A. The washer 578 is mounted on the shaft 572 of the bolt 570 and the shaft 572 is then is inserted through the bore 536A. The retainer clip 584 is then mounted on the shaft 572 in the slot 579. The bolt 570 is thereby secured in the wedge member 520 to form a wedge subassembly 553 that is held together by the retainer clip 584 and the bolt head 574.

In some embodiments, the wedge subassembly 553 is assembled at the factory and provided to the end user or installer assembled. In other embodiments, the wedge subassembly 553 is assembled by the end user and, in some embodiments, is assembled onsite at the location of the tap installation by the installer.

As shown in FIG. 20, the C-shaped sleeve member 510 is placed over the conductor 12 such that the conductor 12 is received in the side channel 516A. The conductor 14 is placed in the other side channel 514A.

The wedge subassembly 553 is partially inserted into the cavity between the conductors 12, 14 such that the conductors 12, 14 are received in the opposed grooves 524A, 526A of the wedge member 520. The wedge member 520 may be forced into the sleeve member 510 by hand or using a hammer or the like to temporarily hold the wedge member 520 and the conductors 12, 14 in position. This may cause the nut 576 to slide forwardly in the boss 568 and protrude forwardly beyond the boss 568. When mated with the C-shaped sleeve member 510, the lock member 550 has clearances between the lock member body 552 and the rear wall of the C-shaped sleeve member 510 and between the features 562, 568 and the ends of the C-shaped sleeve member 510 to allow relative movement between the lock member 550 and the C-shaped sleeve member 510 during installation of the conductors 12, 14. This allows the wedge subassembly 553 to be temporarily secured in the sleeve member 510 (e.g., by hand or using a hammer) as described.

Figure 21:
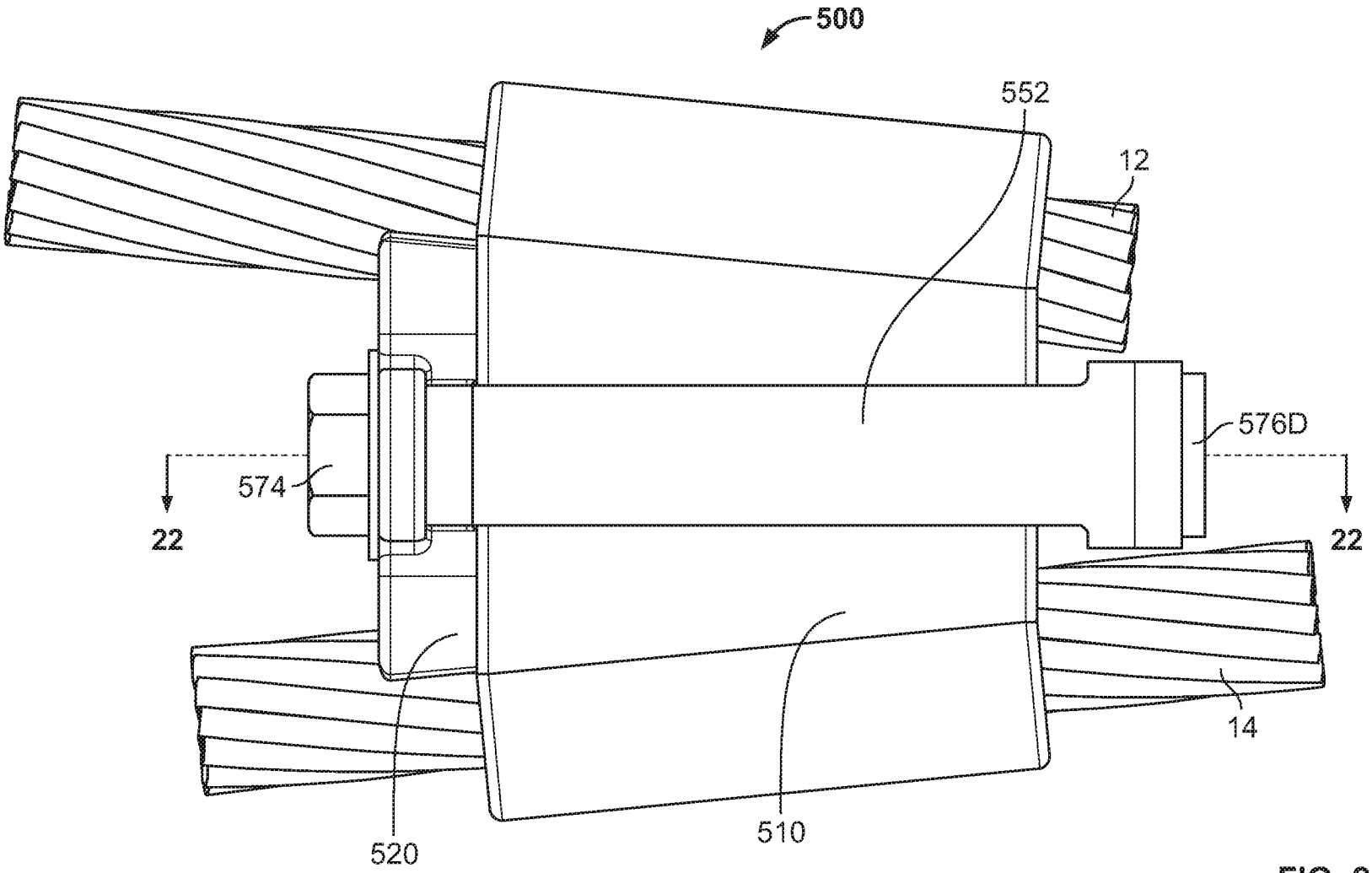
FIG. 21 is a side view, from a side opposite the view of FIG. 20, of a connection including the wedge connector assembly formed from the wedge connector system of FIG. 15.
Figure 22:
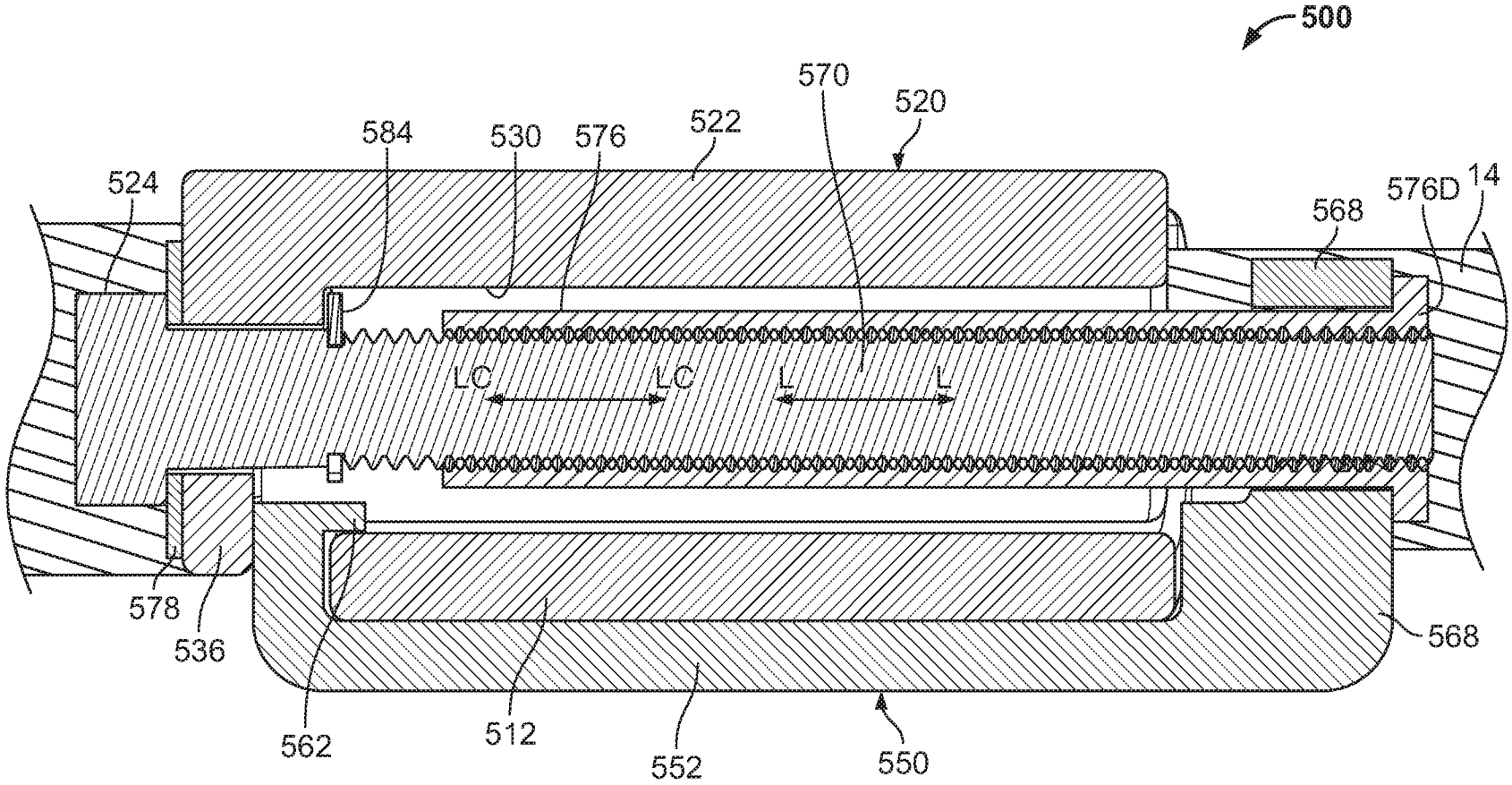
FIG. 22 is a cross-sectional view of the connection of FIG. 21 taken along the line 22-22 of FIG. 21.
Figure 23:
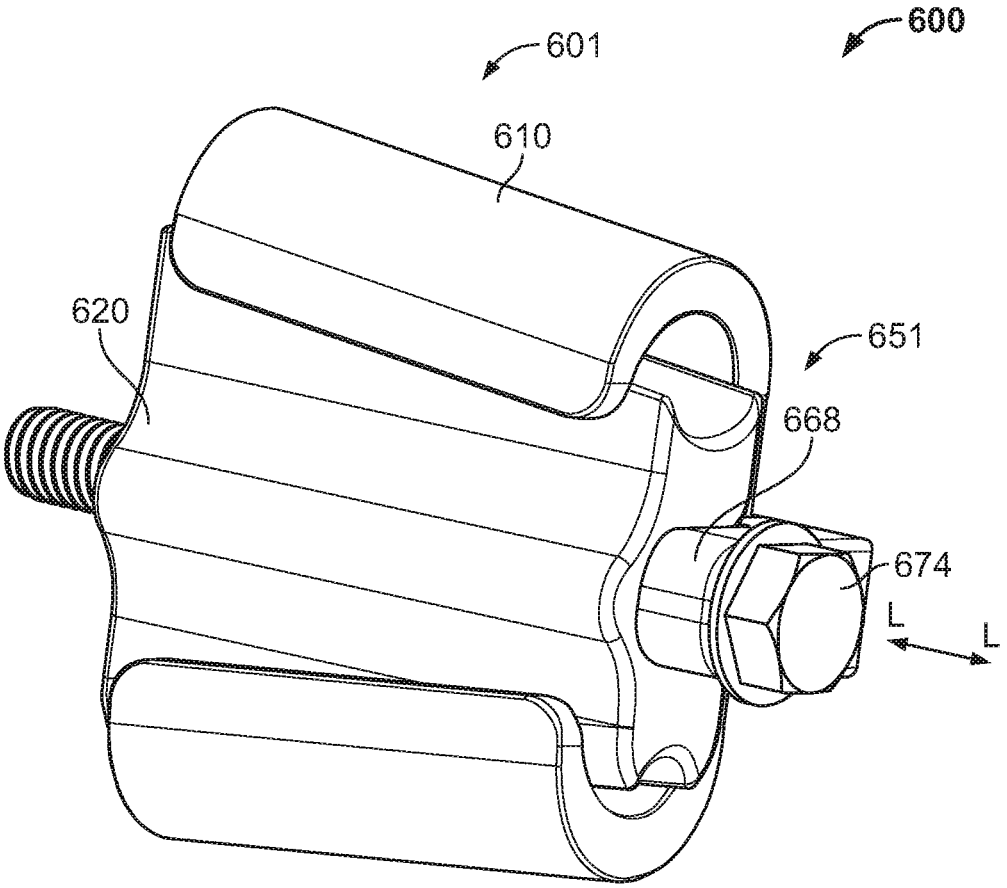
FIG. 23 is a front perspective view of a wedge connector system and wedge connector assembly according to further embodiments of the invention.
Figure 24:
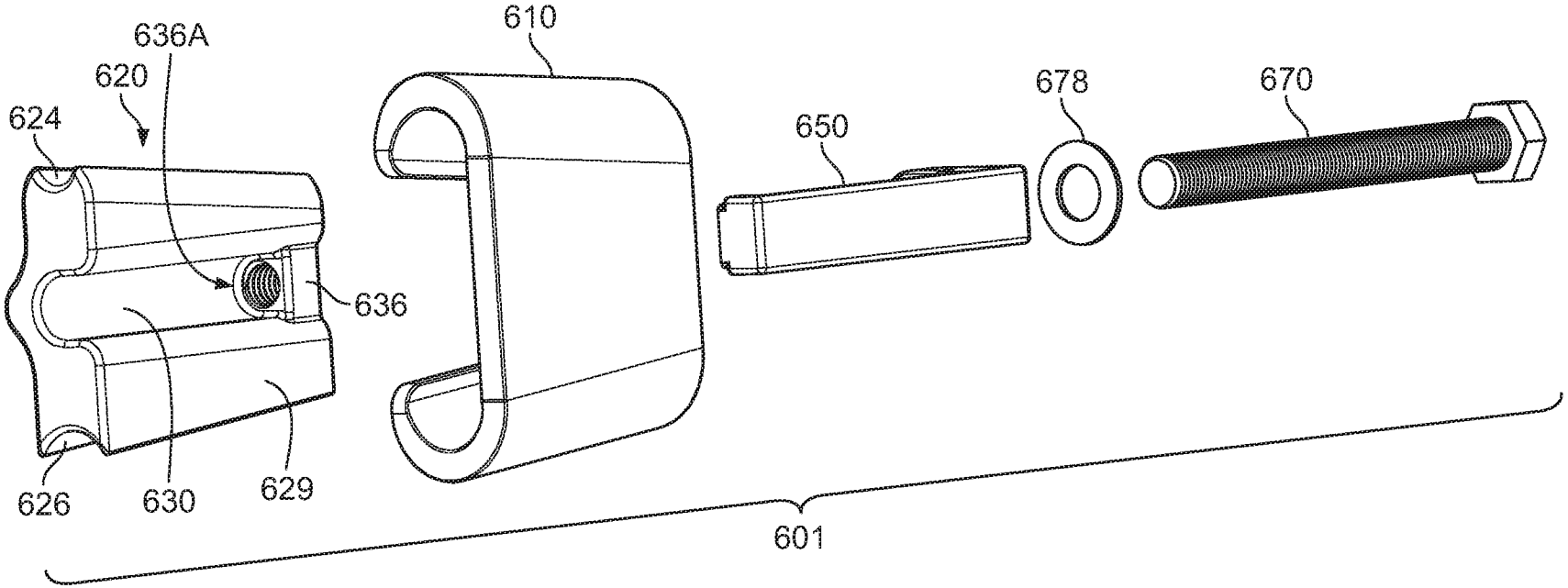
FIG. 24 is an exploded, rear perspective view of the wedge connector system of FIG. 23.
Figure 25:
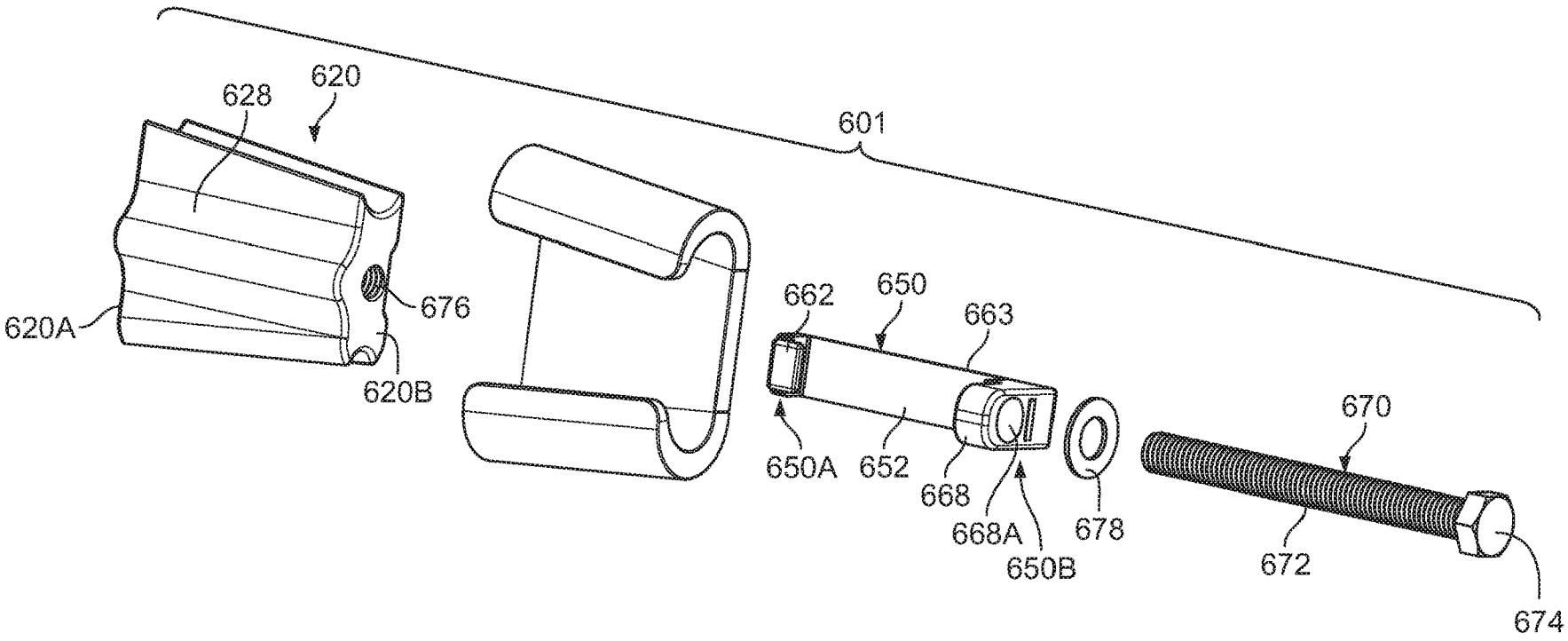
FIG. 25 is an exploded, front perspective view of the wedge connector system of FIG. 23.
Figure 26:
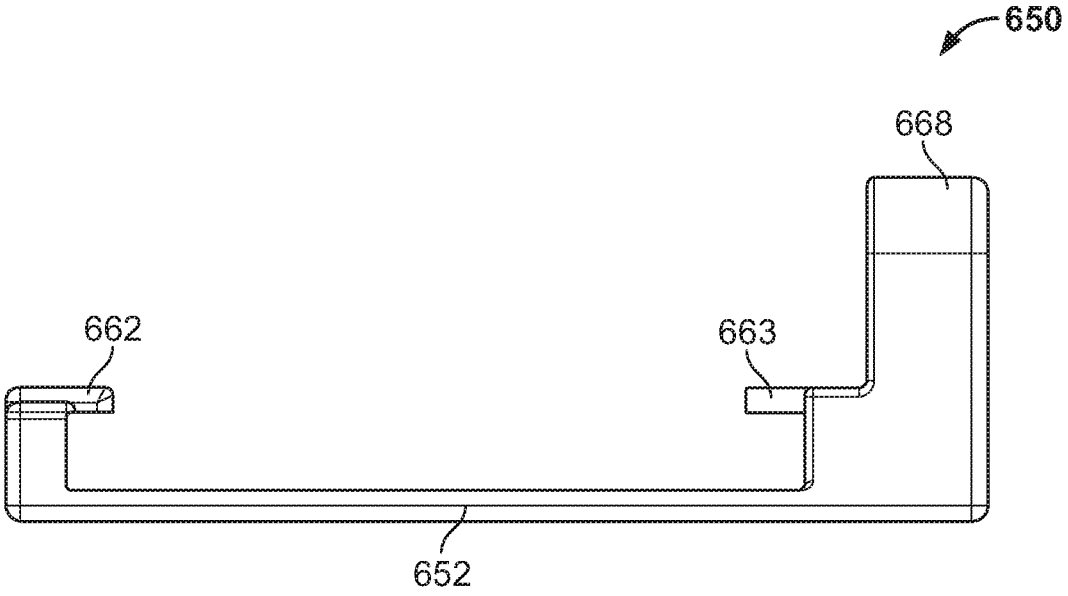
FIG. 26 is a side view of a lock member forming a part of the wedge connector system of FIG. 23.

The front end of the bolt 570 is then threadedly engaged with the nut 576. The nut 576 is prevented from rotation with the bolt 570 by the flats 568C, 576B. As the bolt 570 is rotated (e.g., using a driver 32 and tool 30 as shown in FIG. 2), the nut 576 is drawn axially further into the bore 568A until the stop feature 568D abuts the boss 568. The bolt 570 is rotated (e.g., using driver 32 and tool 30) so that the nut 576 is axially anchored and the bolt 570 forcibly pulls the wedge member 520 into the sleeve member 510 until the wedge member 520 is in a desired final position to form the connection as shown in FIGS. 21 and 22. The boss 568 rotationally fixes or locks the nut 576 for torqueing the bolt 570 during assembly. The boss 536 can act as a hard stop to limit insertion of the wedge member 520. The connection 10 may be formed by forming interference fits between the wedge member 520, the C-shaped sleeve member 510 and the conductors 12, 14. Moreover, the wedge member 520 is secured in place by the lock member 550.

As discussed above with regard to the wedge connector system 101, the wedge member 520, the sleeve member 510 and/or the conductors 12, 14 may be deformed. The C-shaped sleeve member 510 may be elastically deformed so that it applies a bias or spring force against the wedge member 520 and the conductors 12, 14. The sleeve member 510 may be plastically deformed.

The connector system 501 can be removed and disassembled by rotating the bolt 570 counterclockwise to force the nut 576 to move axially forwardly and away from the bolt head 574. The retainer clip 584 and the front boss 568 cooperate to prevent or limit relative axial displacement between the bolt 570 and lock member 550 and the sleeve member 510. As a result, the bolt rotation force displaces the nut 576 forwardly (along the axis LC-LC) relative to the sleeve member 510. The bolt 570 is rotated in this manner until the stop feature 576D is spaced a short distance (e.g., about 0.5 inch) from the boss 568 and the threads of the bolt 570 remain threadedly engaged with the threads of the nut 576. The front end of the nut 576 is then struck (e.g., by a hammer) to drive the bolt 570 rearwardly. Because the bolt 570 is axially constrained by the retainer clip 584, the drive force is thereby applied to the wedge member 520 to drive the wedge member 520 rearwardly relative to the sleeve member 510. In this way, the sleeve member 510 and the wedge member 520 are freed from one another and the connection.

With reference to FIGS. 23-29, a wedge connector system 601 and a wedge connector assembly 600 according to further embodiments is shown therein. The connector assembly 600 corresponds to and may be used in the same manner as the connector assembly 500, except as discussed below. The connector assembly 600 includes a sleeve member 610 and a wedge member 620, corresponding to the sleeve member 510 and the wedge member 520, respectively. The connector assembly 600 includes a drive/lock mechanism 651. The sleeve member 610 and the wedge member 620 are movable relative to one another to cooperatively mechanically capture the conductors 12, 14 therebetween and electrically connect the conductors 12, 14 to one another.

The wedge member 620 includes a body 622 having opposed, arcuate clamping side faces or walls 624, 626, opposed end faces or walls 623, 625, and opposed outer and inner faces or walls 628, 629. The wedge member 620 tapers inwardly from a relatively wide rear end 620A to a relatively narrow front end 620B.

An axially extending alignment slot 630 is defined in the inner wall 629.

An integral boss 636 is located proximate the front end 620B. The boss 636 projects outwardly from the body 622 in a direction transverse (e.g., perpendicular) to the connector axis L-L and toward the sleeve member 610. A bore 636A extends through the boss 636 substantially parallel to the axis L-L.

The lock mechanism 651 includes a lock member 650, a first drive member 670, a cooperating second drive member 676, and a washer 678. In some embodiments and as shown, the first drive member is a drive bolt 670. In some embodiments and as shown, the second drive member is an internal screw thread 676 formed in the bore 636A. In other embodiments, the screw thread 676 may be formed in a nut rotationally and axially secured within the bore 636. The drive bolt 670 and the threaded bore 636 operate as a clamping mechanism The lock member 650 extends from a rear end 650A to a front end 650B along a lock member axis LC-LC. The lock member 650 includes a longitudinally extending body 652, an integral rear engagement or hook portion 662, an integral front hook portion 663, and an integral front brace portion 668.

The rear hook portion 662 is located on the rear end 650A. The hook portion 662 defines a slot 662A.

The integral front brace portion 668 is a boss located on the front end 650B and projects laterally away from the connecting wall 612 of the sleeve member 610. The front brace portion 668 includes a bore 668A. The inner diameter of the bore 668A is dimensioned to permit the drive bolt 670 to spin freely. The front hook portion 663 projects rearwardly from the brace portion 668.

The bolt 670 has an externally threaded cylindrical shank, rod or shaft 672 and an integral driver engagement feature 674 on the front end of the shaft 672. The driver engagement feature 674 may be provided in the form of a geometric head (e.g., a hexagonal faceted head) or a geometric socket. The drive head 674 may be a hex head as illustrated, for example.

The sleeve member 610, wedge member 620, lock member 650, and bolt 670 may be formed of materials and using techniques as described above for the sleeve member 110, wedge member 120, lock member 150, bolt 170, and nut 176.

Exemplary methods for assembling and using the connector assembly 600 in accordance with embodiments of the present invention will now be described.

Figure 27:
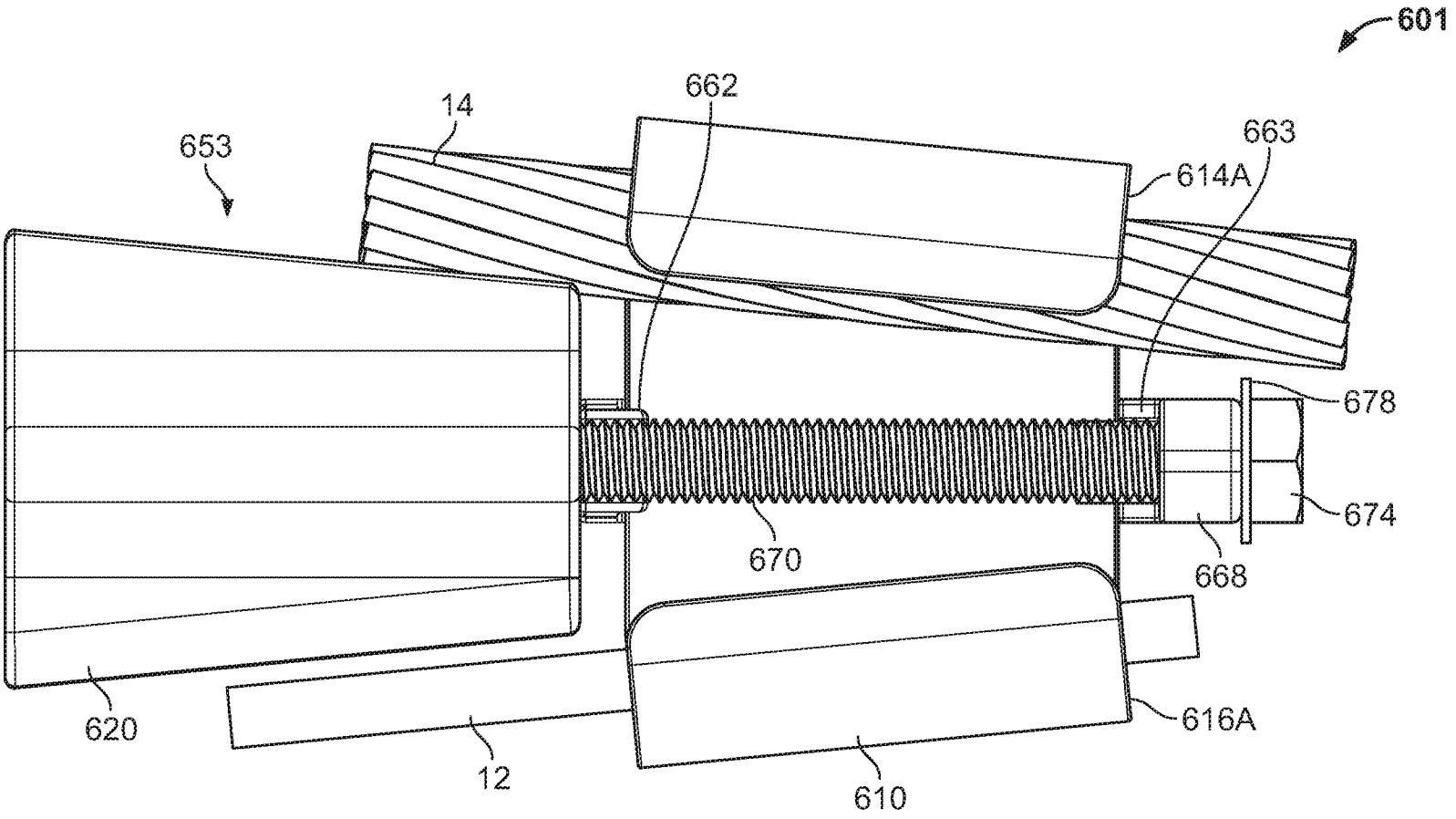
FIG. 27 is side view of the wedge connector system of FIG. 23 mounted on a pair of conductors, wherein the wedge connector system is in an open position.

In order to assemble the wedge connector assembly 600, the lock member 650 is mounted on the sleeve member 610 as shown in FIG. 27 such that the rear edge of the sleeve member 610 is received and captured in the slot 662A and the front edge of the sleeve member 610 is captured by the front hook portion 663. The lock member body 652 extends along the outside of the sleeve member connecting portion 612. The brace portion 668 is positioned at the front end 610B of the sleeve member 610.

The washer 678 is mounted on the shaft 672 of the bolt 670 and the shaft 672 is then is inserted through the bore 668A. The bolt 670 is threaded into the threaded bore 636A of the wedge member 620. The bolt 670 is thereby secured in the wedge member 620 and the lock member 650 to form a wedge subassembly 653.

In some embodiments, the wedge subassembly 653 is assembled at the factory and provided to the end user or installer assembled. In other embodiments, the wedge subassembly 653 is assembled by the end user and, in some embodiments, is assembled onsite at the location of the tap installation by the installer.

As shown in FIG. 27, the C-shaped sleeve member 610 is placed over the conductor 12 such that the conductor 12 is received in the side channel 616A. The conductor 14 is placed in the other side channel 614A.

The wedge subassembly 653 is inserted into the cavity between the conductors 12, 14 such that the conductors 12, 14 are received in the opposed grooves 624A, 626A of the wedge member 620. The wedge member 620 may be forced into the sleeve member 610 by hand or using a hammer or the like to temporarily hold the wedge member 620 and the conductors 12, 14 in position.

Figure 28:
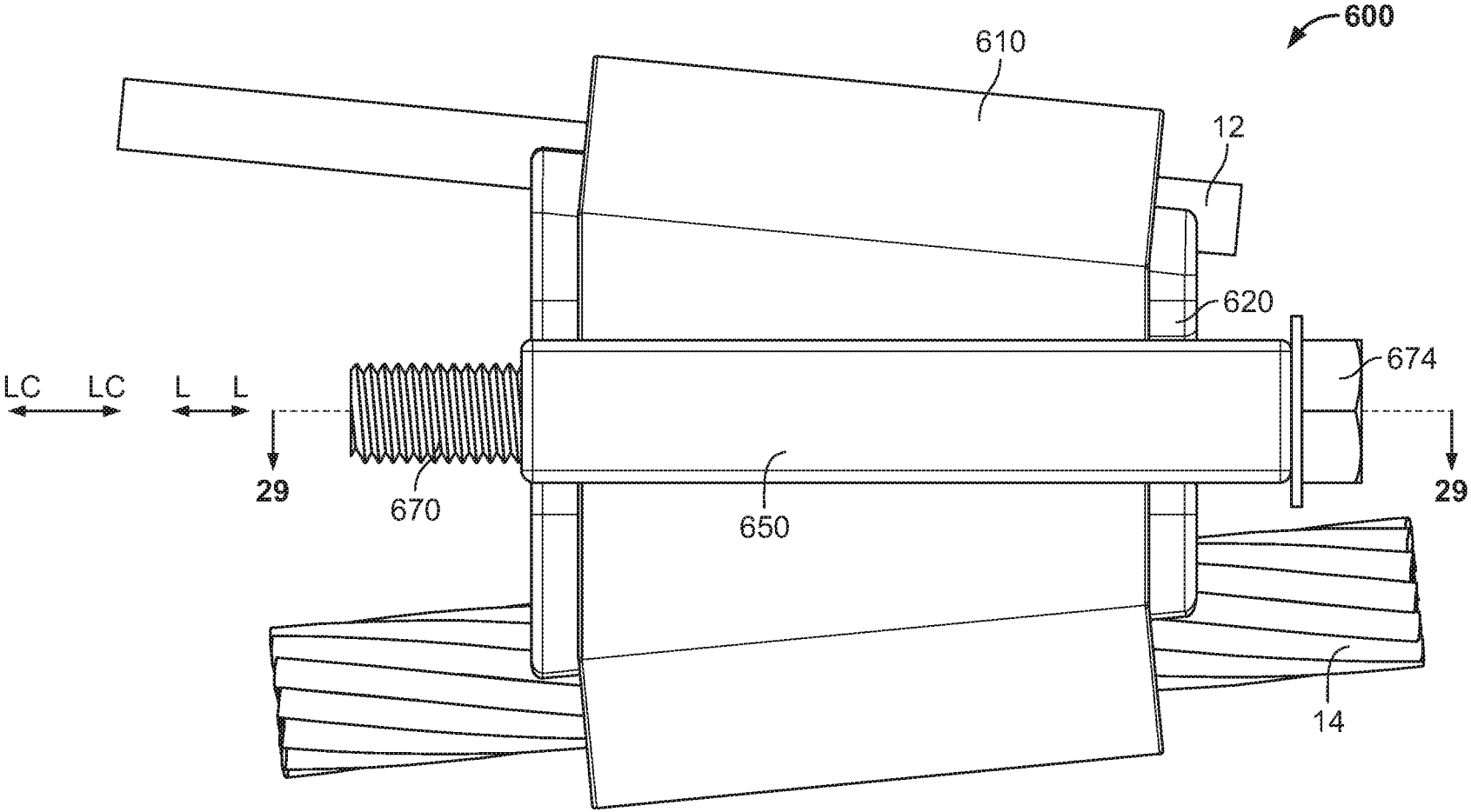
FIG. 28 is a side view, from a side opposite the view of FIG. 27, of a connection including the wedge connector assembly of FIG. 23.
Figure 29:
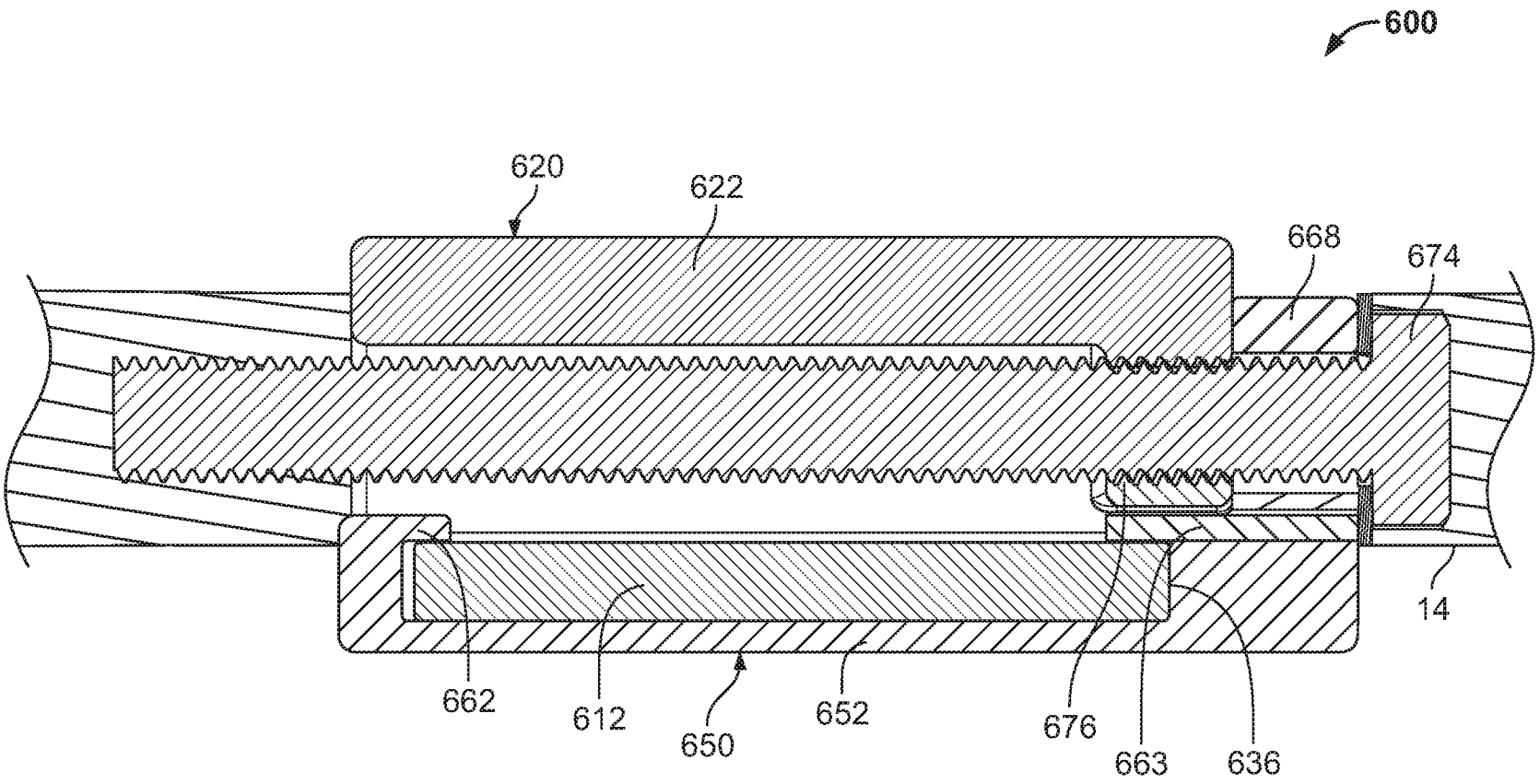
FIG. 29 is a cross-sectional view of the connection of FIG. 28 taken along the line 29-29 of FIG. 28.

The bolt 670 is then further rotated (e.g., using a driver 32 and tool 30 as shown in FIG. 2), so that the bolt head 674 loads against the brace portion 668 and the bolt 670 forcibly pulls the wedge member 620 forwardly into the sleeve member 610 until the wedge member 620 is in a desired final position to form the connection as shown in FIGS. 28 and 29. The connection 10 may be formed by forming interference fits between the wedge member 620, the C-shaped sleeve member 610 and the conductors 12, 14. Moreover, the wedge member 620 is secured in place by the lock member 650.

As discussed above with regard to the wedge connector system 101, the wedge member 620, the sleeve member 610 and/or the conductors 12, 14 may be deformed. The C-shaped sleeve member 610 may be elastically deformed so that it applies a bias or spring force against the wedge member 620 and the conductors 12, 14. The sleeve member 610 may be plastically deformed.

The connector system 601 can be removed and disassembled by rotating the bolt 670 counterclockwise. This forces the bolt 670 to back out or move axially forwardly (along the axis LC-LC) relative to the sleeve member 610 and away from the wedge 610 and the brace portion 668. The bolt 670 is rotated in this manner until the bolt head 674 is spaced a short distance (e.g., about 0.5 inch) from the brace portion 668. The bolt head 674 is then struck (e.g., by a hammer) to drive the bolt 670 rearwardly. Because the bolt 670 is axially constrained with respect to the wedge member 610 by the mated threads of the bolt 670 and the bore 636A, the drive force is thereby applied to the wedge member 620 to drive the wedge member 620 rearwardly relative to the sleeve member 610. In this way, the sleeve member 610 and the wedge member 620 are freed from one another and the connection.

Figure 30:
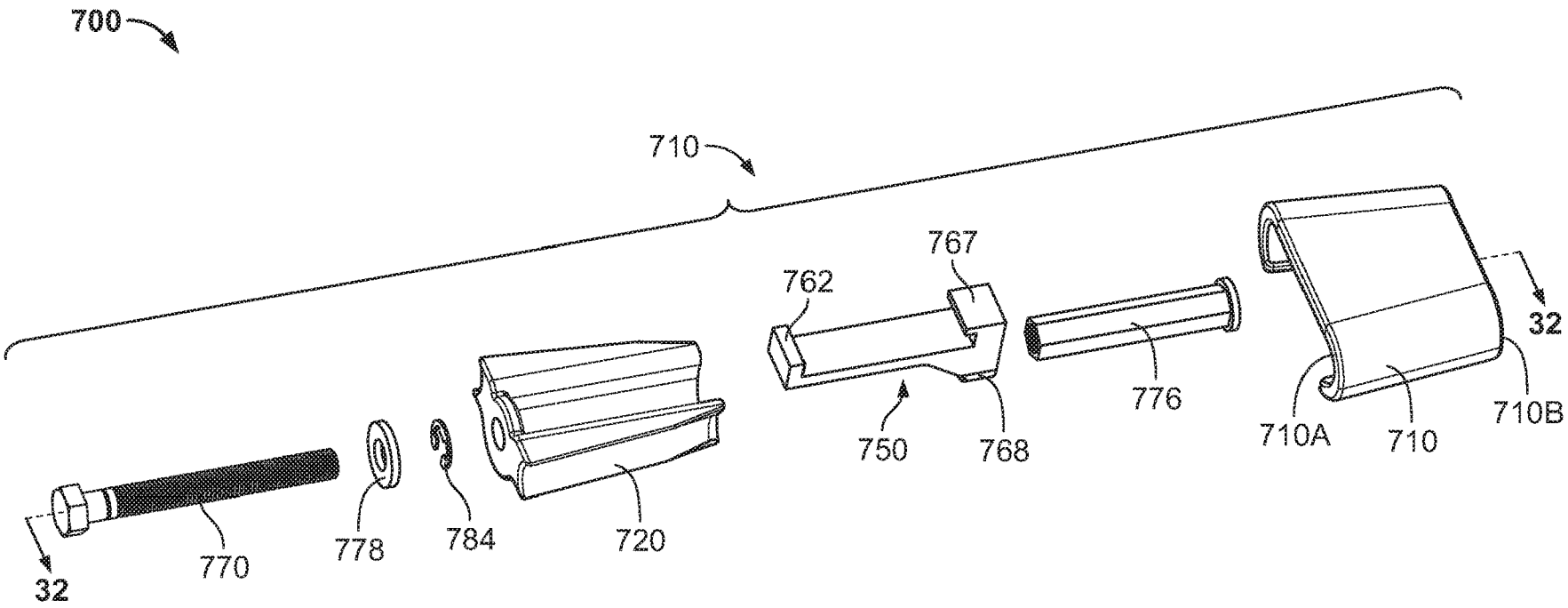
FIG. 30 is an exploded, rear perspective view of a wedge connector system according to further embodiments of the invention.
Figure 31:
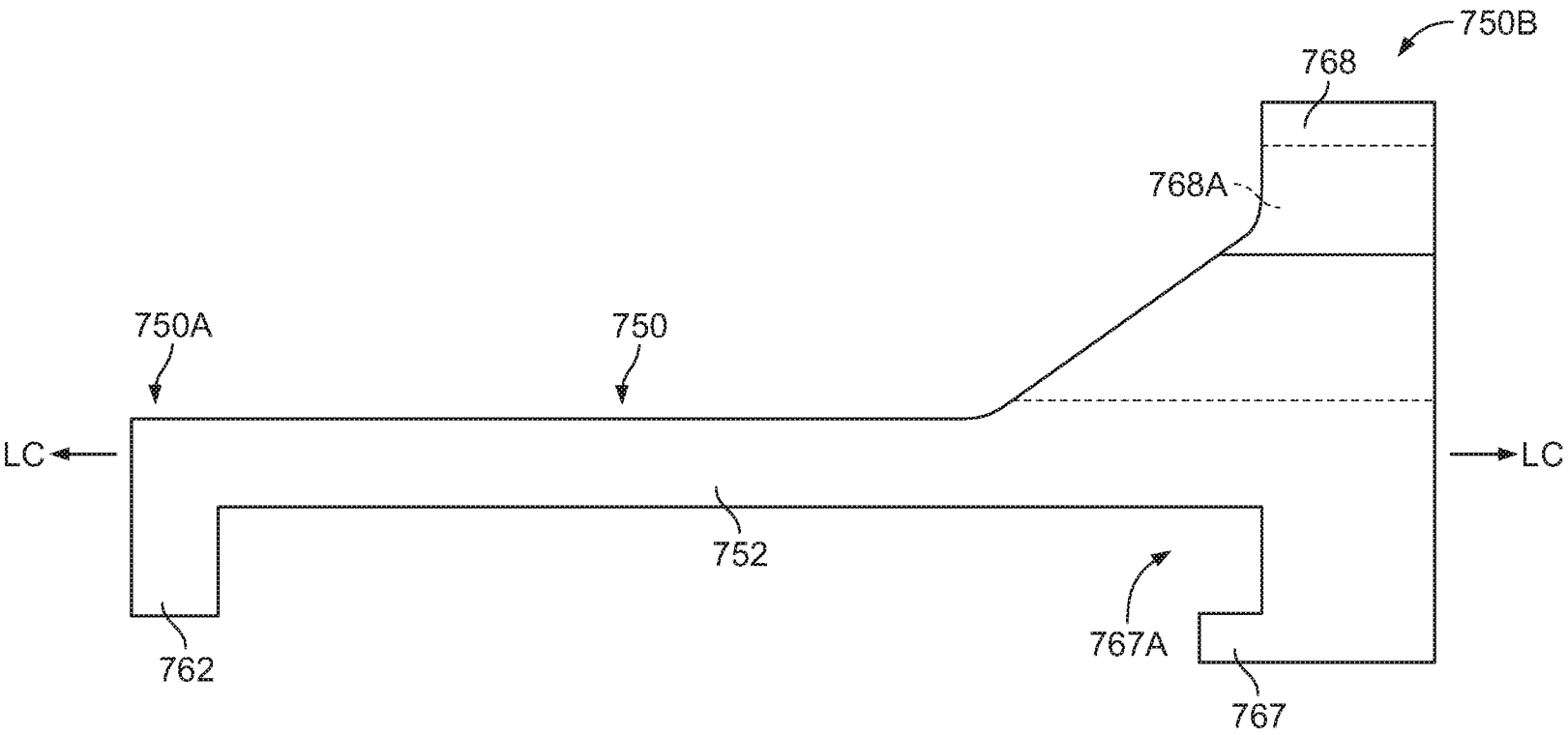
FIG. 31 is a side view of a lock member forming a part of the wedge connector system of FIG. 30.
Figure 32:
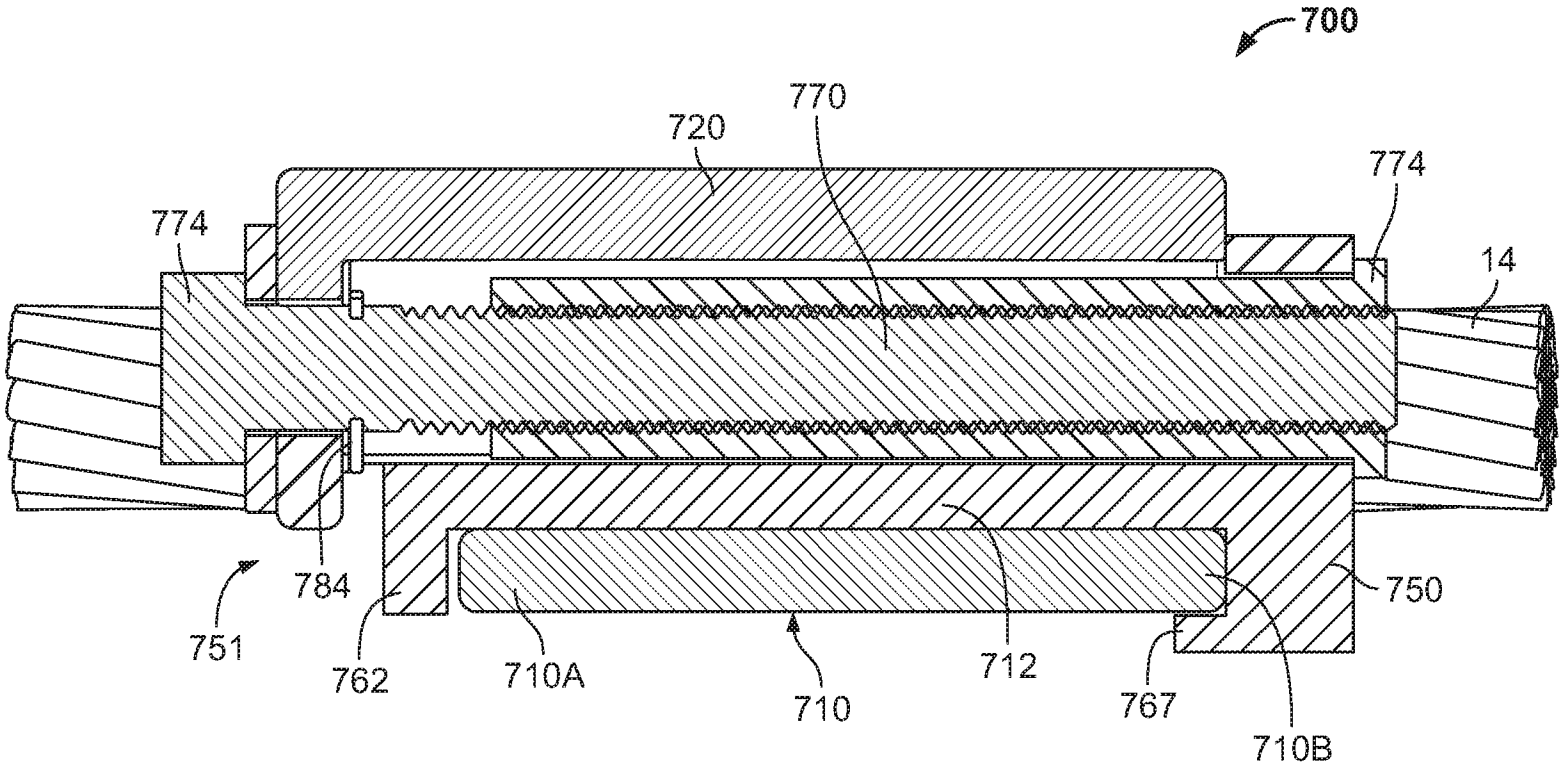
FIG. 32 is a cross-sectional view of a connection including the wedge connector system of FIG. 30 taken along the line 32-32 of FIG. 30.

With reference to FIGS. 30-32, a wedge connector system 701 and a wedge connector assembly 700 according to further embodiments is shown therein. The connector assembly 700 corresponds to and may be used in the same manner as the connector assembly 500, except as discussed below. The connector assembly 700 includes a sleeve member 710 and a wedge member 720, corresponding to the sleeve member 510 and the wedge member 520, respectively. The connector assembly 700 includes a drive/lock mechanism 751. The sleeve member 710 and the wedge member 720 are movable relative to one another to cooperatively mechanically capture the conductors 12, 14 therebetween and electrically connect the conductors 12, 14 to one another.

The lock mechanism 751 includes a lock member 750, a first drive member 770, a cooperating second drive member 776, a washer 778, and a retainer clip 784. In some embodiments and as shown, the first drive member is a drive bolt 770 and the second drive member is a nut 776. The drive bolt 770 and the nut 776 operate as a clamping mechanism.

The lock member 750 extends from a rear end 750A to a front end 750B along a lock member axis LC-LC. The lock member 750 includes a longitudinally extending body 752, an integral rear engagement or stop portion 762, an integral front engagement or hook portion 767, and an integral nut holder portion 768.

The stop portion 762 is located on the rear end 750A. The hook portion 767 is located on the front end 750A. The hook portion 767 defines a slot 767A. The stop portion 762 and the hook portion 767 project laterally toward the connecting wall 712 of the sleeve member 710 when the connector is assembled.

The nut holder portion 768 is a boss located on the front end 750B and projects laterally away from the connecting wall 712 of the sleeve member 710 when the connector is assembled. The nut holder portion 768 includes a bore 768A. Anti-rotation features in the form of flats are located in the bore 768A and define a hexagonal passage.

The retainer clip 784 is seated in an annular retainer ring mount slot 779 defined in the outer surface of the bolt 770 proximate the head 774. The retainer clip 784 is thereby positioned on front side of the boss 736, opposite the bolt head 774. The retainer clip 784 permits the bolt 770 to rotate about the bolt's lengthwise axis relative to the boss 736, but limits relative rearward axial displacement of the bolt 770 relative to the boss 736. In this way, the retainer clip 784 prevents the bolt from moving rearwardly out of the boss 736 beyond a relatively short prescribed distance. Other retention devices (e.g., a split pin) or features may be used in addition to or in place of the retainer clip 784 to axially constrain the bolt 770 relative to the wedge member 720 while permitting the bolt 770 to rotate relative to the wedge member 720.

The nut 776 is constructed in the same manner as the nut 576, except that the forward end of the bore terminates at an opening 776E so that the bolt 770 can extend fully through and beyond the front end of the nut 776. The nut 776 is seated in the bore 768A and functions in the same manner as described for the nut 576 and the bore 568A.

The sleeve member 710, wedge member 720, lock member 750, bolt 770, and nut 776 may be formed of materials and using techniques as described above for the sleeve member 110, wedge member 120, lock member 150, bolt 170, and nut 176.

The connector assembly 700 can be used in the same manner as the connector assembly 500, except as follows. The longitudinally extending body 752 is interposed laterally between the wedge member 720 and the connecting wall 712 of the sleeve member 710. The stop portion 762 is located adjacent and may abut the rear end 710A of the sleeve member 710. The hook portion 767 is located adjacent and receives the front end 710B of the sleeve member 710 in the slot 767A when the connector is assembled. The construction of the connector assembly 700 may allow for or facilitate use with other accessories such as hot-sticks.

The connector system 701 can be removed and disassembled by rotating the bolt 770 counterclockwise to force the nut 776 to move axially forwardly and away from the bolt head 774, and then striking (e.g., with a hammer) the front end of the nut 576 to drive the bolt 570 rearwardly, as described above for the connector system 501.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A wedge connector system for connecting first and second elongate electrical conductors, the wedge connector system comprising:

a C-shaped sleeve member defining a sleeve cavity and opposed first and second sleeve channels on either side of the sleeve cavity;

a wedge member including a wedge body having first and second opposed wedge side walls; and a locking mechanism including:

a lock member including a sleeve engagement portion; and a clamping mechanism coupled to the wedge member;

wherein:

the sleeve member and the wedge member are configured to capture the first and second conductors such that the first conductor is received in the first sleeve channel between the sleeve member and the first wedge side wall and the second conductor is received in the second sleeve channel between the sleeve member and the second wedge side wall;

the locking mechanism is mountable on the sleeve member and the wedge member such that the sleeve engagement portion interlocks with the sleeve member and the clamping mechanism can be operated to force the wedge member and the lock member to converge and thereby force the wedge member into the sleeve cavity to apply clamping loads on the first and second conductors;

the clamping mechanism includes a bolt having a head and a threaded shaft extending from the head;

the wedge member has opposed front and rear ends;

the front end leads the rear end as the wedge member is advanced into the sleeve cavity by the clamping mechanism;

the bolt head is accessible from the rear end of the wedge member to be engaged by a tool to rotate the bolt and thereby force the wedge member into the sleeve cavity;

the clamping mechanism further includes:

an integral boss formed on the wedge member; and an integral threaded bore in the lock member;

the threaded shaft threadedly engages the threaded bore;

the bolt and the threaded bore cooperate to linearly displace the lock member responsive to rotation of the bolt; and the integral boss is configured to transfer a drive force from the bolt to the wedge member to force the wedge member into the sleeve cavity to apply a clamping load on the first and second conductors.

2. The wedge connector system of claim 1 wherein:

the sleeve member has opposed rear and front ends;

the first and second sleeve channels taper inwardly in a direction from the rear end of the sleeve member to the front end of the sleeve member; and the first and second wedge side walls taper inwardly in a direction from the rear end of the wedge member to the front end of the wedge member.

3. The wedge connector system of claim 1 wherein the wedge member includes first and second opposed wedge channels defined in the first and second wedge side walls, respectively.

4. The wedge connector system of claim 1 wherein the sleeve member is a resilient spring member that elastically deflects when the wedge member is forced into the sleeve cavity to apply the clamping loads on the first and second conductors.

5. The wedge connector system of claim 4 wherein the wedge member includes an integral deflection slot defined therein and positioned to receive a deflected portion of the sleeve member when the resilient spring member is elastically deflected by the wedge member.

6. The wedge connector system of claim 1 wherein the engagement portion includes a sleeve receiver slot configured to hold a front end of the sleeve member when the locking mechanism is mounted on the sleeve member.

7. The wedge connector system of claim 1 wherein:

the wedge member includes a guide slot;

the lock member includes a guide rail slidably received in the guide slot; and the guide slot and the guide rail cooperate to maintain alignment between the sleeve member and the wedge member as the wedge member is forced into the sleeve cavity by the clamping mechanism.

8. The wedge connector system of claim 7 wherein:

the sleeve member includes a connecting portion between the first and second sleeve channels; and the guide rail is disposed between the connecting portion and the wedge member when the locking mechanism is mounted on the sleeve member.

9. The wedge connector system of claim 8 wherein the threaded shaft of the bolt is located on a side of the wedge member opposite the guide rail.

10. The wedge connector system of claim 1 wherein the sleeve member includes a connecting portion between the first and second sleeve channels; and the lock member includes a longitudinally extending body disposed between the connecting portion and the wedge member when the locking mechanism is mounted on the sleeve member.

11. A method for connecting first and second elongate electrical conductors, the method comprising:

providing a wedge connector assembly including:

a C-shaped sleeve member defining a sleeve cavity and opposed first and second sleeve channels on either side of the sleeve cavity;

a wedge member including a wedge body having first and second opposed wedge side walls; and a locking mechanism including:

a lock member including a sleeve engagement portion; and a clamping mechanism coupled to the wedge member;

using the sleeve member and the wedge member, capturing the first and second conductors such that the first conductor is received in the first sleeve channel between the sleeve member and the first wedge side wall and the second conductor is received in the second sleeve channel between the sleeve member and the second wedge side wall;

mounting the locking mechanism on the sleeve member and the wedge member such that the sleeve engagement portion interlocks with the sleeve member; and thereafter operating the clamping mechanism to force the wedge member and the lock member to converge and thereby force the wedge member into the sleeve cavity to apply clamping loads on the first and second conductors;

wherein:

the clamping mechanism includes a bolt having a head and a threaded shaft extending from the head;

the wedge member has opposed front and rear ends;

the front end leads the rear end as the wedge member is advanced into the sleeve cavity by the clamping mechanism;

the bolt head is accessible from the rear end of the wedge member to be engaged by a tool to rotate the bolt and thereby force the wedge member into the sleeve cavity;

the clamping mechanism further includes:

an integral boss formed on the wedge member; and an integral threaded bore in the lock member;

the threaded shaft threadedly engages the threaded bore;

the bolt and the threaded bore cooperate to linearly displace the lock ember responsive to rotation of the bolt; and the integral boss is configured to transfer a drive force from the bolt to the wedge member to force the wedge member into the sleeve cavity to apply a clamping load on the first and second conductors.

12. The wedge connector system of claim 1 wherein the locking mechanism does not form a part of the sleeve member.

13. The wedge connector system of claim 1 wherein the wedge member, the lock member, and the bolt collectively form a wedge subassembly.

14. The method of claim 11 wherein the locking mechanism does not form a part of the sleeve member.

15. The method of claim 11 wherein:

the wedge member, the lock member, and the bolt collectively form a wedge subassembly; and the method includes forming the wedge subassembly and thereafter mounting the wedge subassembly on the sleeve member.

16. A wedge connector system for connecting first and second elongate electrical conductors, the wedge connector system comprising:

a C-shaped sleeve member defining a sleeve cavity and opposed first and second sleeve channels on either side of the sleeve cavity;

a wedge member including a wedge body having first and second opposed wedge side walls; and a locking mechanism including:

a lock member including a sleeve engagement portion; and a clamping, mechanism coupled to the wedge member;

wherein:

the sleeve member and the wedge member are configured to capture the first and second conductors such that the first conductor is received in the first sleeve channel between the sleeve member and the first wedge side wall and the second conductor is received in the second sleeve channel between the sleeve member and the second wedge side wall;

the locking mechanism is mountable on the sleeve member and the wedge member such that the sleeve engagement portion interlocks with the sleeve member and the clamping mechanism can be operated to force the wedge member and the lock member to converge and thereby force the wedge member into the sleeve cavity to apply clamping loads on the first and second conductors;

the wedge member includes a guide slot;

the lock member includes a guide rail slidably received in the guide slot; and the guide slot and the guide rail cooperate to maintain alignment between the sleeve member and the wedge member as the wedge member is forced into the sleeve cavity by the clamping mechanism.

17. The wedge connector system of claim 16 wherein:

the sleeve member includes a connecting portion between the first and second sleeve channels; and the guide rail is disposed between the connecting portion and the wedge member when the locking mechanism is mounted on the sleeve member.

18. The wedge connector system of claim 17 wherein the clamping mechanism includes a threaded drive member located on a side of the wedge member opposite the guide rail.

19. A wedge connector system for connecting first and second elongate electrical conductors, the wedge connector system comprising:

a C-shaped sleeve member defining a sleeve cavity and opposed first and second sleeve channels on either side of the sleeve cavity;

a wedge member including a wedge body having first and second opposed wedge side walls; and a locking mechanism including:

a lock member including a sleeve engagement portion; and a clamping mechanism coupled to the wedge member;

wherein:

the sleeve member and the wedge member are configured to capture the first and second conductors such that the first conductor is received in the first sleeve channel between the sleeve member and the first wedge side wall and the second conductor is received in the second sleeve channel between the sleeve member and the second wedge side wall;

the locking mechanism is mountable on the sleeve member and the wedge member such that the sleeve engagement portion interlocks with the sleeve member and the clamping mechanism can be operated to force the wedge member and the lock member to converge and thereby force the wedge member into the sleeve cavity to apply clamping loads on the first and second conductors;

the clamping mechanism includes a bolt having a head and a threaded shaft extending from the head;

the wedge member has opposed front and rear ends;

the front end leads the rear end as the wedge member is advanced into the sleeve cavity by the clamping mechanism;

the bolt head is accessible from the front end of the wedge member to be engaged by a tool to rotate the bolt and thereby force the wedge member into the sleeve cavity;

the clamping mechanism further includes:

an integral boss formed on the lock member; and an integral threaded bore in the wedge member;

the threaded shaft threadedly engages the threaded bore;

the bolt and the threaded bore cooperate to linearly displace the lock member responsive to rotation of the bolt; and the integral boss is configured to transfer a drive force from the bolt to the wedge member to force the wedge member into the sleeve cavity to apply a clamping load on the first and second conductors.

* * * * *